US008687986B2

(12) United States Patent
Okanishi et al.

(10) Patent No.: US 8,687,986 B2
(45) Date of Patent: Apr. 1, 2014

(54) IMAGE FORMING APPARATUS WITH DEFLECTION AMOUNT DETECTOR AND TONER DENSITY DETECTION MEANS

(75) Inventors: Tadashi Okanishi, Mishima (JP); Shinri Watanabe, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 180 days.

(21) Appl. No.: 13/008,941

(22) Filed: Jan. 19, 2011

(65) Prior Publication Data

US 2011/0182606 A1 Jul. 28, 2011

(30) Foreign Application Priority Data

Jan. 26, 2010 (JP) ..... 2010-014101

(51) Int. Cl.
*G03G 15/00* (2006.01)

(52) U.S. Cl.
USPC ..... 399/49; 399/397

(58) Field of Classification Search
CPC ..... G03G 2215/00755; G03G 2215/00616
USPC ..... 399/396, 394, 66, 67, 68, 397
See application file for complete search history.

(56) References Cited

U.S. PATENT DOCUMENTS 6,789,868 B2 9/2004 Hata et al.
6,873,820 B2 3/2005 Tanaka et al.
7,729,005 B2 6/2010 Okanishi et al.
8,155,543 B2 * 4/2012 Ishibashi et al. ..... 399/49
8,200,143 B2 * 6/2012 Shiobara ..... 399/397
2009/0245827 A1 10/2009 Matsumoto

FOREIGN PATENT DOCUMENTS

JP 2000-89605 A 3/2000
JP 2001-106380 A 4/2001
JP 2002145478 A 5/2002
JP 2009122518 A 6/2009
JP 2009265627 A 11/2009

OTHER PUBLICATIONS

McGraw-Hill Dictionary of Scientific and Technical Terms Fifth Edition, Copyright 1994, see attached p. 857.*

* cited by examiner

*Primary Examiner* — Daniel J Colilla
*Assistant Examiner* — John M Royston
(74) *Attorney, Agent, or Firm* — Fitzpatrick, Cella, Harper & Scinto

(57) ABSTRACT

The image forming apparatus includes a loop amount detection sensor, disposed between a secondary transfer part and a fixing part, for detecting a loop amount of a transfer material by detecting a reflection of light radiated on the transfer material, a density detection sensor for detecting a density of a toner image that is primarily transferred to the intermediate transfer belt with the primary transfer roller, and a loop control part for controlling the loop amount of the transfer material based on the density of the toner image that is detected by the density detection sensor and the loop amount that is detected by the loop amount detection sensor. Accordingly, the image forming apparatus attains higher accuracy in the deflection amount detection by performing the deflection amount detection at least with the dependency of the image formed on the transfer material mitigated.

13 Claims, 18 Drawing Sheets

IMAGE FORMING APPARATUS WITH DEFLECTION AMOUNT DETECTOR AND TONER DENSITY DETECTION MEANS

BACKGROUND OF THE INVENTION

1. Field of the Invention

The present invention relates to control on deflection amount of a transfer material on which an image is formed by an image forming apparatus.

2. Description of the Related Art

In an image forming apparatus, a transfer material is conveyed in contact with a plurality of rotatable members. In that case, it is known that a deflection amount (referred to as a loop amount) of the transfer material being conveyed is controlled to be constant so that the transfer material is neither pulled nor pushed in the conveyance direction. The sensors for detecting the loop amount include a sensor consisting of a photo-interrupter and a mechanism flag and a sensor employing a reflective optical sensor, for example. FIG. 2B is a diagram illustrating a configuration and operation of an apparatus for detecting a loop amount with a reflective optical sensor. An optical sensor can measure a distance to a transfer material by emitting light from an emission part 50*a* and receiving the light reflected from the top surface of the transfer material at a light reception part 50*b*. With the measurement results, the apparatus successively detects the loop amount of the transfer material and controls a drive unit of a secondary transfer part 20 or a fixing part 34 so that the loop amount of the transfer material becomes the same as the preset loop amount (see Japanese Patent Application Laid-Open No. 2000-89605 and Japanese Patent Application Laid-Open No. 2001-106380, for example).

A problem emerged, however, in that when a reflective optical sensor is used for detecting the loop of the transfer material, the feature of the sensor leads to an error in the loop detection result depending on the density of the top surface of the transfer material. For example, some optical sensors triangulate the distance to an object by receiving an infrared ray irradiated from the emission part at the light reception part made of a Position Sensitive Detector (PSD). In that type of optical sensor, a change in the reflection amount due to such reasons as a change in the density of the top surface of the transfer material or the image formed on the top surface of the transfer material leads to a difference between the actual distance to the transfer material and the detected distance to the transfer material. Therefore, there is a problem in that a reflective optical sensor used for detecting a loop amount cannot give a correct loop amount for some transfer materials or some images transferred on the transfer material.

SUMMARY OF THE INVENTION

The present invention is made under the circumstances and has an object of improving the accuracy in detecting the deflection amount by performing the deflection amount detection with at least the dependency of the image formed on the transfer material mitigated.

In order to solve the above-mentioned problem, the present invention is configured as below.

(1) An image forming apparatus for primarily transferring a toner image to an intermediate transfer member with a primary transfer unit, secondarily transferring the toner image primarily transferred to the intermediate transfer member to a transfer material with a secondary transfer unit, and fixing the image secondarily transferred to the transfer material with a fixing unit including: a deflection amount detector, disposed between the secondary transfer unit and the fixing unit, for detecting information indicating a deflection amount of the transfer material by detecting a reflection of light irradiated on the transfer material; a density detector for detecting a density of the toner image that is primarily transferred to the intermediate transfer member with the primary transfer unit; and a controller for controlling the deflection amount of the transfer material based on the density of the toner image that is detected by the density detector and the information indicating the deflection amount that is detected by the deflection amount detector.

(2) An image forming apparatus for primarily transferring a toner image to an intermediate transfer member with a primary transfer unit, secondarily transferring the toner image primarily transferred to the intermediate transfer member to a transfer material with a secondary transfer unit, and fixing the image secondarily transferred to the transfer material with a fixing unit including: a deflection amount detector, disposed between the secondary transfer unit and the fixing unit, for detecting information indicating a deflection amount of the transfer material by detecting a reflection of light irradiated on the transfer material; a detection unit for detecting glossiness of the transfer material or a color value of the secondarily transferred image; and a controller for controlling the deflection amount of the transfer material based on the detection result by the detection unit and the information indicating the deflection amount that is detected by the deflection amount detector.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

Embodiments according to the present invention will be described below in detail with reference to the drawings. The components described in these embodiments, however, are merely an example and are not intended to limit the scope of the invention to them, if it is not described in particular.

Figure 1:
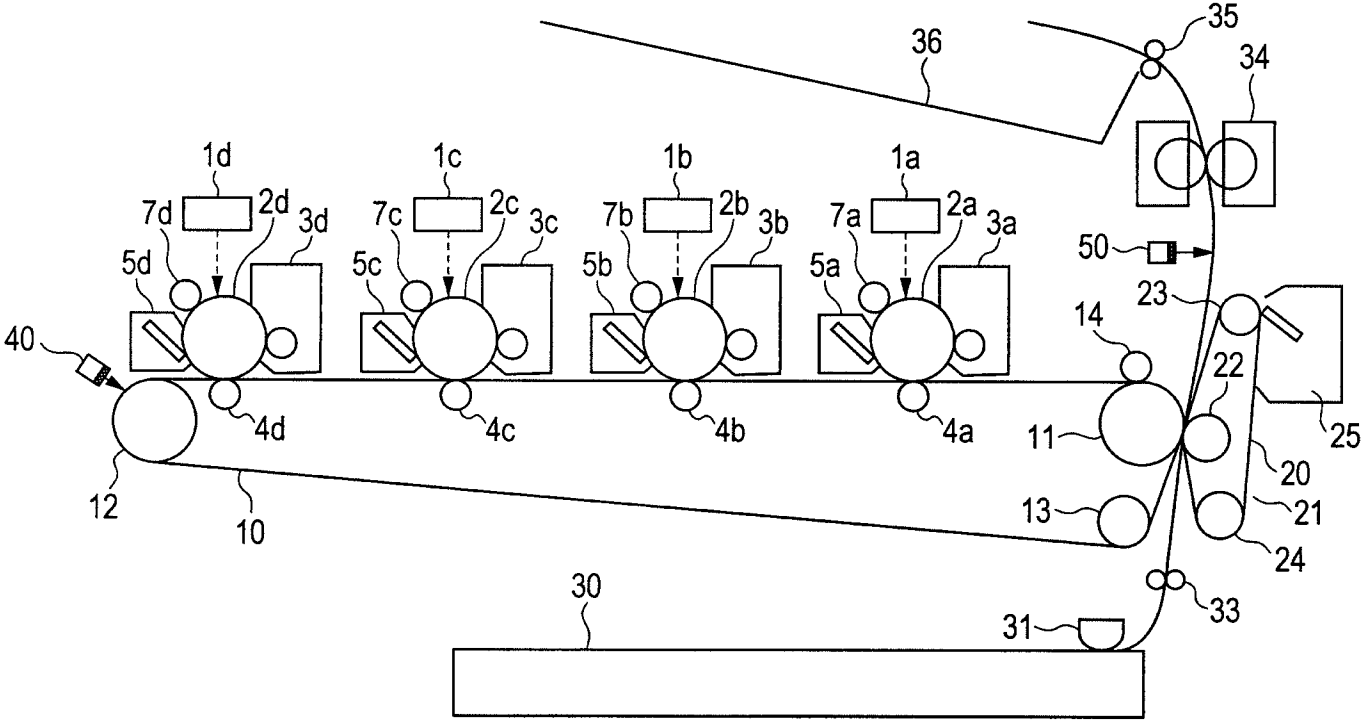
FIG. 1 is a schematic diagram of an image forming apparatus.

[Description of Configuration of the Image Forming Apparatus: FIG. 1]

FIG. 1 is a block diagram of an image forming apparatus according to the first embodiment. A density detection sensor 40 detects a top surface of an intermediate transfer belt 10 and a toner image on the intermediate transfer belt 10 (on the intermediate transfer member). A loop detection sensor 50 detects a top surface of a transfer material 30 and an image on the transfer material 30 transferred by a secondary transfer part 20. A loop of the transfer material 30 is formed between the secondary transfer part 20 and a fixing part 34 (see FIG. 2B), and a control part 600 to be described later controls the loop amount by controlling the rotational speed of the fixing part 34 based on the detection result of the loop detection sensor 50.

The toner image to be detected by the density detection sensor 40 or the loop detection sensor 50 is formed by the image forming apparatus to be described below, for example. The image forming apparatus of the embodiment has four electrophotographic sensitive drums (hereinafter, called photosensitive drums) 2*a*, 2*b*, 2*c* and 2*d* for image carriers of yellow, magenta, cyan and black disposed in parallel. Here, a, b, c and d are codes indicating yellow, magenta, cyan and black, respectively, and omitted in the description below, if otherwise they are needed in particular. There are disposed around the photosensitive drum 2, from the upstream side in the direction of rotation in order, a charge device 7 as a charging unit, a developing device 3 as a developing unit and a cleaner 5 as a cleaning unit. The charge device 7 uniformly charges the top surface of the clockwisely rotating photosensitive drum 2, and a scanner 1 as an exposure unit irradiates a laser beam on the top surface of the photosensitive drum 2 based on image information to form an electrostatic latent image. The developing device 3 applies toners (developer) of respective colors to the top surface of the photosensitive drum 2 that has an electrostatic latent image formed thereon to make the latent image visible as a toner image. The cleaner 5 removes the residual toner from the top surface of the photosensitive drum 2 after the image being transferred. The intermediate transfer belt 10 as an intermediate transfer member for the toner image to be primarily transferred from the photosensitive drum 2 is extended on a driving roller 11, a tension roller 12 and a driven roller 13 at the place opposite to the photosensitive drum 2. A residual toner charging roller 14 for charging a residual toner on the intermediate transfer belt 10 is disposed at the intermediate transfer belt 10 that moves in the counterclockwise direction and charges a secondary transfer residual toner, the toner residual after the secondary transfer. The secondary transfer residual toner charged by the residual toner charging roller 14 remains on the intermediate transfer belt 10 to be moved to an image forming station, where it is reversely transferred to the photosensitive drum 2 and collected by the cleaner 5. When it is controlled based on time, the position in the toner image is converted into time as $t=1/v$ where the distance from the leading edge of the image at the time t is assumed 1 when the toner image is conveyed at the conveyance speed v.

The secondary transfer part 20 as a secondary transfer unit is disposed at the position opposite to the driving roller 11 across the intermediate transfer belt 10. For the secondary transfer part 20, the secondary transfer belt 21 is extended on a secondary transfer driving roller and a secondary transfer tension roller 24, and a secondary transfer roller 22 is disposed at the position opposite to the driving roller 11. A secondary transfer cleaner 25, which is a resin blade type secondary transfer cleaning unit for removing a toner from the secondary transfer belt 21, is disposed at the position opposite to the secondary transfer driving roller 23. The primary transfer roller 4 as a primary transfer unit primarily transfers the toner images formed on the respective photosensitive drums 2 to the intermediate transfer belt 10. On the other hand, the transfer material 30 is fed from a feeding cassette by a pick-up roller 31. The transfer material 30 is separately fed into a pair of registration rollers 33 by a separate unit (Not Shown) one by one, and conveyed to the secondary transfer position between the intermediate transfer belt 10 and the secondary transfer belt 21 at predetermined timing by the pair of the registration rollers 33. The secondary transfer roller 22 secondarily transfers the toner image primarily transferred to the intermediate transfer belt 10 to the transfer material 30. The fixing part 34 as a fixing unit fixes the toner image on the transfer material 30, and a pair of discharging rollers 35 discharges the transfer material 30 onto a discharge tray 36 provided on the top of the image forming apparatus body.

Figure 2A:
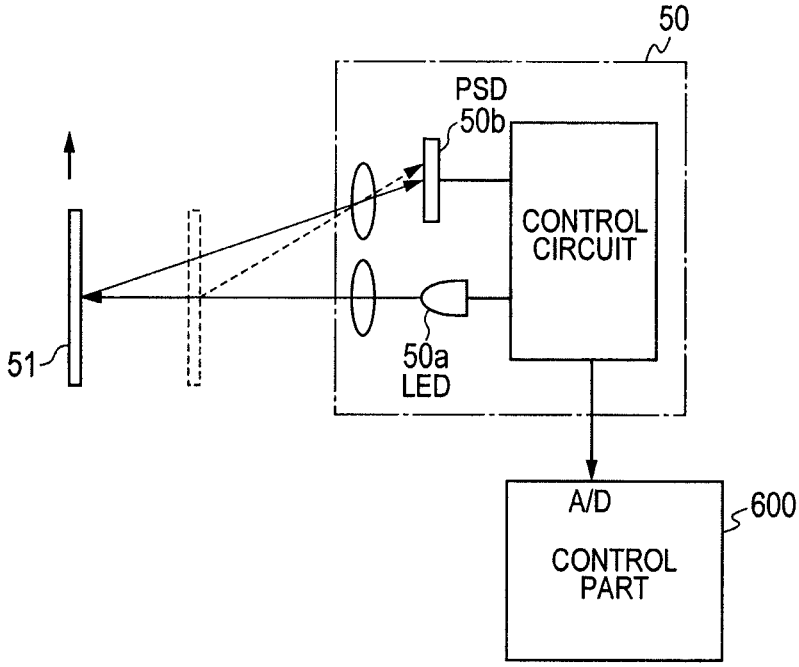
FIG. 2A illustrates a configuration of a loop detection sensor.
Figure 2B:
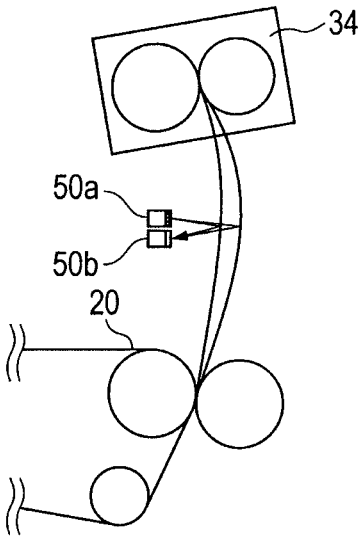
FIGS. 2B and 2C illustrate schematic diagrams of the loop detection sensor.
Figure 2C:
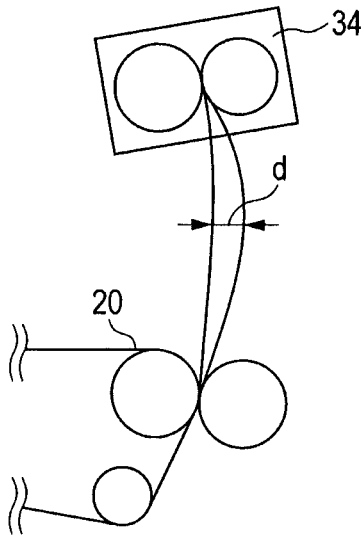

[Description of Loop Detection Sensor: FIG. 2A to FIG. 2C]

In general, a change in temperature of the pair of rollers of the fixing part 34 appears as a change in the outer diameter. Accordingly, the conveyance speed of the transfer material passing through the fixing part 34 varies, even if the driving speed of a drive motor 6 (see FIG. 4), the driving source of the fixing part 34, is the same. At a lower temperature, the outer diameter becomes smaller, whereby the conveyance speed of the fixing part 34 becomes lower than that of the intermediate transfer belt 10. At a higher temperature, they become conversely. In either case, there is a difference between the conveyance speeds of the intermediate transfer belt 10 and the fixing part 34, which results in pulling or pushing of the transfer material thereby causing the color misregistration and artifacts in transferring the image.

Then, a control part (control part 600 to be described later) controls (changes) the rotational speed of the fixing part 34 by controlling the drive motor 6 with a motor control part 615 (see FIG. 4). Accordingly, the control part 600 can control the conveyance speed of the transfer material that is conveyed while being nipped by a nip part of the fixing part 34 and the nip part of the secondary transfer part 20, respectively. In the image forming apparatus, a non-contact optical sensor (hereinafter, called loop detection sensor 50) for measuring a distance to the transfer material is disposed between the secondary transfer position (secondary transfer nip part) and the fixing part 34 (fixing nip part). With the loop detection sensor 50, the control part 600 can detect how much deflection (loop amount) is formed in the transfer material. In the embodiment, the distance from the loop detection sensor 50 to the transfer material is detected as a parameter for measuring the loop (deflection) of the transfer material. Then, based on the detection result, the control part 600 controls via a loop control part 610 for speeding up and down the drive motor 6, the driving source, to keep the loop amount from causing the pulling or pushing of the transfer material (hereinafter, this control is called 'loop control'). Here, the loop means that the transfer material is bending and the loop amount means the degree of deflection of the transfer material. The loop amount can be represented by d shown in FIG. 2C, for example. The reference alphabet d in FIG. 2C shows how much the transfer material deflected from the ideal state of that with no difference between the conveyance speeds of the transfer material. Here, in all the embodiments shown below, the loop detection sensor 50 detects information indirectly indicating the loop amount, and not directly detects the loop amount (it is a matter of course that the sensor may be adapted to directly detect the amount). Therefore, the description 'to detect the loop amount' meaning 'to detect information indicating the loop amount' below can be construed as 'to detect information indicating the loop amount'.

The loop detection sensor 50 includes the LED emission part 50*a* and the light reception part 50*b* of the PSD (Position Sensitive Detector) as shown in FIG. 2A, for example. The loop detection sensor 50 irradiates an infrared ray from the emission part 50*a* to an object 51 such as the transfer material, and receives the infrared ray reflected from the object 51 by the light reception part 50*b*. The loop detection sensor 50 triangulates the distance to the object 51 with a control circuit by using the position of the center of a distribution of the infrared ray that reached the photosensitive surface. In the figure, the object 51 is shown by a solid line and a dashed line as it is placed at different distances from the loop detection sensor 50. An analog signal according to the distance measured by the loop detection sensor 50 is input into an A/D port of the control part 600. When the regularity reflection amount (reflected light amount) is reduced by infrared absorption due to a change in density of the image on the object 51, each detection device of the PSD has an error in its detection position in the loop detection sensor 50. Accordingly, as a result, a change in the regularity reflection amount from the image on the transfer material leads to an error in the distance to the transfer material measured by the control circuit of the loop detection sensor 50.

Figure 3A:
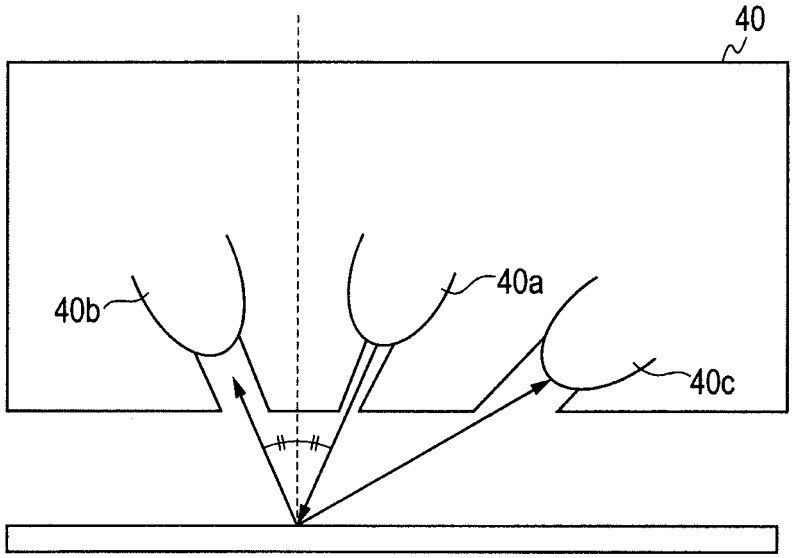
FIG. 3A illustrates physical relationships of a density detection sensor.
Figure 3B:
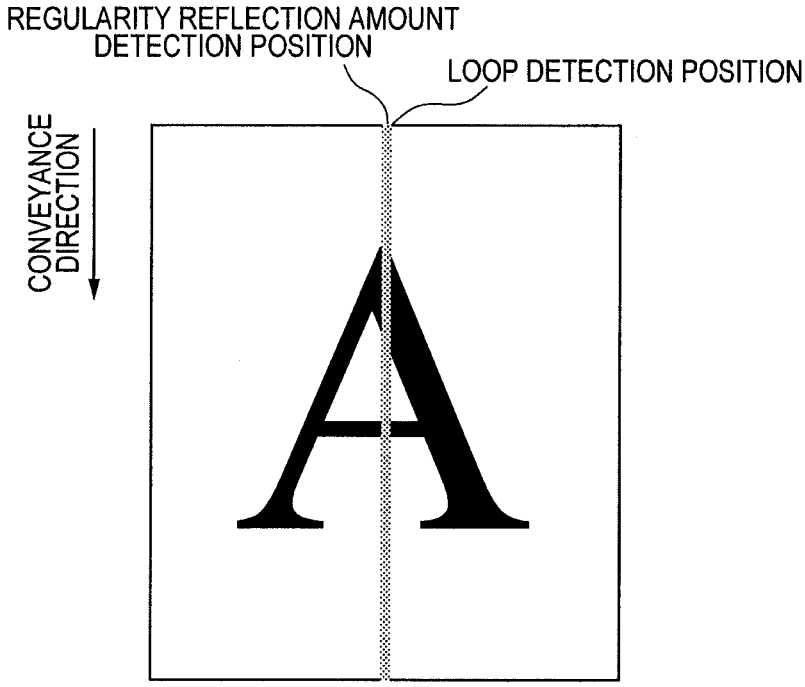
FIG. 3B illustrates an outline of a detection method of the density detection sensor.

[Description of Density Detection Sensor: FIGS. 3A and 3B]

The image forming apparatus has the density detection sensor 40 as an optical detection unit disposed at the opposite part of the intermediate transfer belt 10, and because of the accurate color reproduction capability and tone stability of the sensor 40, the control part 600 performs image density control based on the detection result from the density detection sensor 40. Particularly, since the tone varies according to a change in the environment of the apparatus, histories of the consumables, a change in the state of the image forming apparatus body during operation, and the like, image density control is performed at a predetermined timing in order to keep the tone stable so that the imaging conditions are set to appropriate values. Here, the image density control refers to an already-known control, a control for changing the image forming conditions to keep the actually detected density to a target density by detecting the density of a density detection patch using the density detection sensor. Changing of the image forming conditions may include, for example, changing of a developing bias value of the developing device 3 and calculation (setting) of a tone correction table for converting (correcting) the tone of the input image data. It is a matter of course that the present invention is not limited to the examples.

With reference to FIG. 3A, the density detection sensor 40 will be described in detail. As shown in FIG. 3A, the density detection sensor 40 includes a light-emitting element 40*a*, a light-receiving element 40*b*, a light-receiving element 40*c* and a holder. The light-receiving element 40*b* is arranged at the acceptance angle the same as the irradiation angle, and receives the regularity reflection component and the diffused reflection component. The light-receiving element 40*c* is arranged at the acceptance angle different from the irradiation angle, and receives only the diffused reflection component. Then the detection results are converted into analog signals according to the detected amount by the control circuit of a sensor (not shown) and input into an A/D converter of the control part 600. The image density can be calculated by the control part 600 performing a calculation process based on the measurement results of the reflection from the intermediate transfer belt 10 and from the image on the intermediate transfer belt 10 received by the two light-receiving elements 40*b* and 40*c*. The density detection sensor 40 is disposed so that its detection position for the regularity reflection amount is the same as that of the loop detection sensor 50 in the main scanning direction of the image (the direction perpendicular to the conveyance direction) (see FIG. 3B).

[Description of Block Diagram of Image Forming Apparatus: FIG. 4]

Figure 4:
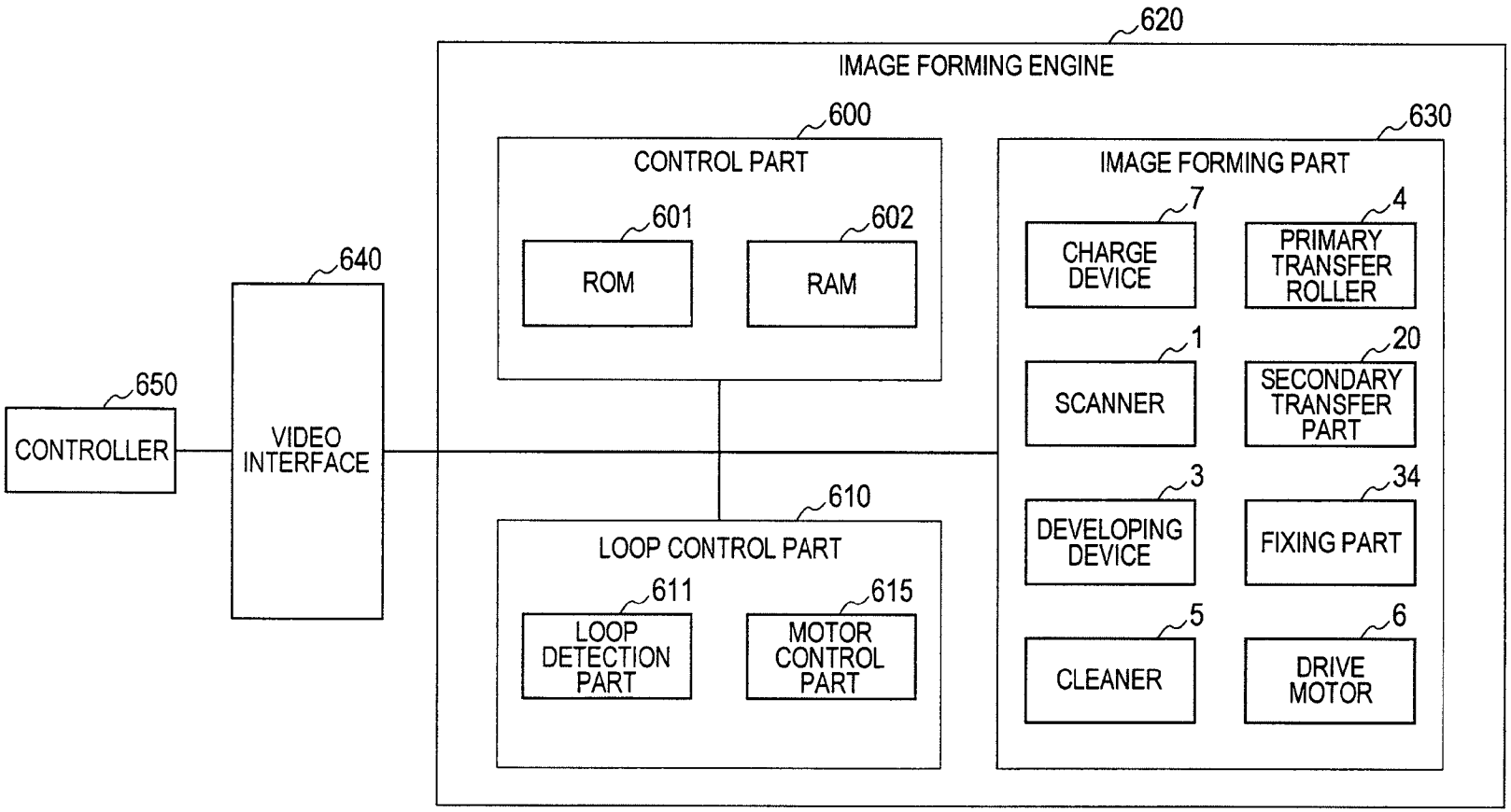
FIG. 4 illustrates a block diagram of the image forming apparatus.

FIG. 4 is a block diagram illustrating an example of configuration of the control part of the image forming apparatus according to the embodiment. The image forming engine 620 forms an image according to a command from a controller 650 via a video interface 640. An image forming part 630 includes the above-mentioned charge device 7, scanner 1, developing device 3, cleaner 5, primary transfer roller 4, secondary transfer part 20, fixing part 34, drive motor 6 and the like. The loop control part 610 has a loop detection part 611 and a motor control part 615. A loop detection part 611, which corresponds to the control circuit of the loop detection sensor 50 described with reference to FIGS. 2A to 2C, performs control and various calculations with respect to detection by the loop detection sensor 50. The control part 600 has a CPU (not shown), a ROM 601 (non-volatile storage unit) and a RAM 602 (volatile storage unit). The control part 600 causes the loop control part 610 to perform specific control, while controlling the respective parts of the image forming part 630 by using the RAM 602 as a working area based on respective control programs stored in the ROM 601. Although the control part 600 and the loop control part 610 are described separately in the above embodiment, one of them may be adapted to perform another part's function.

Here, the loop control will be described in detail. Since the length between the secondary transfer part 20 and the fixing part 34 is shorter than the length of the transfer material, it is required to allow the transfer material fed out from the secondary transfer part 20 to form a free loop to absorb the conveyance force of the secondary transfer part 20 and the fixing part 34 to prevent these parts from pulling the transfer material from each other. Therefore, the loop detection sensor 50 disposed between the secondary transfer part 20 and the fixing part 34 detects the loop amount based on an instruction from the control part 600. Then, the control part 600 performs drive control on the fixing roller and the drive motor 6 of a pressure roller by using the motor control part 615 based on the detected loop amount, and adjusts the rotational speed of respective rotatable members. For example, if the detected loop amount is less than a preset threshold, the control part 600 slows down the rotational speeds of the fixing roller and the pressure roller by certain times to increase the loop amount, and if the loop amount is more than the threshold, the control part 600 speeds up these rotational speeds by certain times to decrease the loop amount. Here, it can be adapted to drive any one of the fixing roller and the pressure roller by the drive motor 6, making the other one a driven roller. In this manner, the control part 600 controls the conveyance speed of the fixing part 34 to keep the loop amount of the transfer material nipped and conveyed by these rollers constant via the loop control part 610. The term constant used here refers to approximately constant that the loop amount is within certain allowable limits and needs not to be construed as an exact certain value.

Figure 5A:
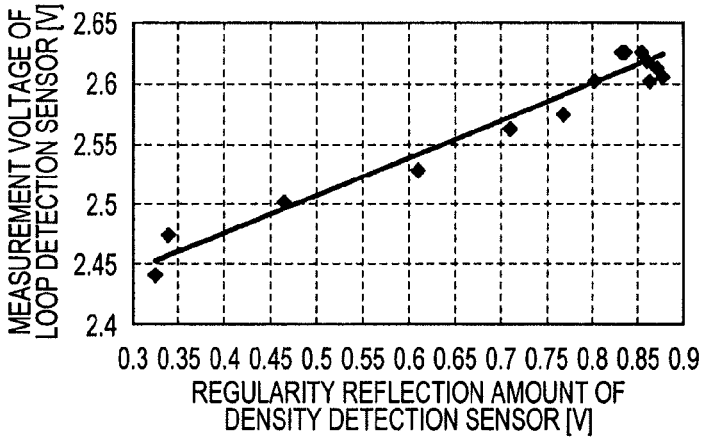
FIG. 5A is a diagram illustrating a detection result of the loop detection sensor by relationship between a regularity reflection amount and a measurement voltage.
Figure 5B:
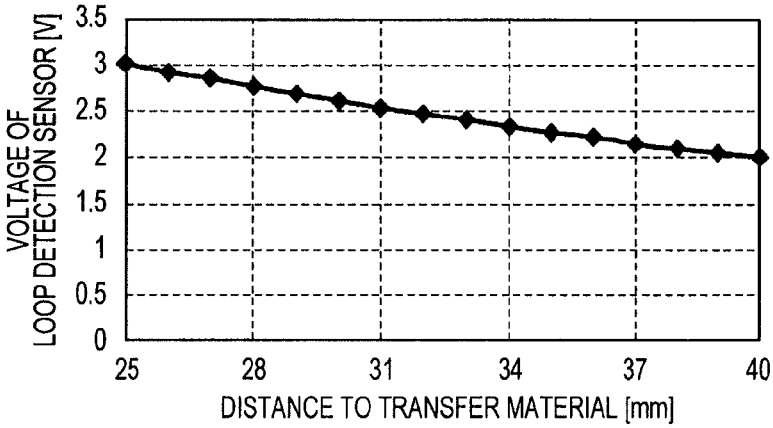
FIG. 5B is a diagram illustrating a detection result of the loop detection sensor by relationship between a distance and a voltage.
Figure 5C:
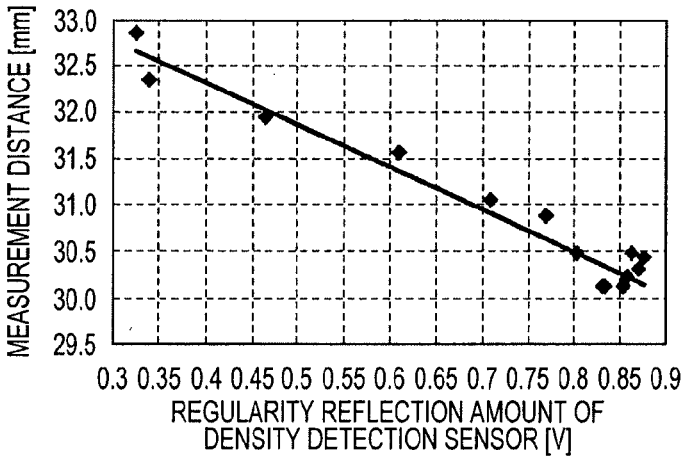
FIG. 5C is a diagram illustrating a detection result of the loop detection sensor by relationship between the regularity reflection amount and the measurement distance.

[About Loop Detection Sensor and Reflection Amount: FIGS. 5A to 5C]

The loop detection sensor 50 is influenced by the regularity reflection amount from the image formed on the top surface of the transfer material. Accordingly, the value detected by the loop detection sensor 50 at the point where the image is formed has an error according to the density. From FIG. 5A to FIG. 5C are information stored in the ROM 601 of the image forming apparatus that is used by the control part 600 in correcting the occurred error.

FIG. 5A is a graph in which the abscissa represents the regularity reflection amount detected by the light-receiving element 40*b* of the density detection sensor as density and the ordinate represents the results detected by the loop detection sensor 50 where the distance between the loop detection sensor 50 and the transfer material is constant (for example, 30 mm). As such, if the distance between the loop detection sensor 50 and the transfer material is constant, the voltage value (V) obtained from the loop detection sensor 50 increases as the image regularity reflection amount (V) (merely described as regularity reflection amount in the FIGURES detected by the density detection sensor 40 increases. In general, it shows that the toner amount is large when the regularity reflection amount is small, and the toner amount is small when the regularity reflection amount is large. For that reason, the abscissa in FIG. 5A shows that the color becomes closer to white as the regularity reflection amount (output results obtained from the light-receiving element 40*b* of the density detection sensor 40) increases. FIG. 5B is a graph illustrating voltage (V) obtained from the loop detection sensor 50 and the distance (mm) to the transfer material. FIG. 5C is a graph in which the ordinate in FIG. 5A is converted into distance based on FIG. 5B. According to FIG. 5C, it can be understood that there is a difference about 3 mm between the minimum value and the maximum value of the regularity reflection amount by the density detection sensor 40.

Then, the control part 600 performs a process of correcting the error from the loop detection sensor 50 based on the result obtained from the image regularity reflection amount detected by the density detection sensor 40, for the distance to the transfer material detected by the loop detection sensor 50. Accordingly, the control part 600 can calculate the correct distance to the transfer material, thereby performing more accurate loop control on the transfer material via the loop control part 610.

[About Correction Timing of Loop Detection Sensor: FIG. 6, FIG. 7, FIG. 8A and FIG. 8B]

Figure 6:
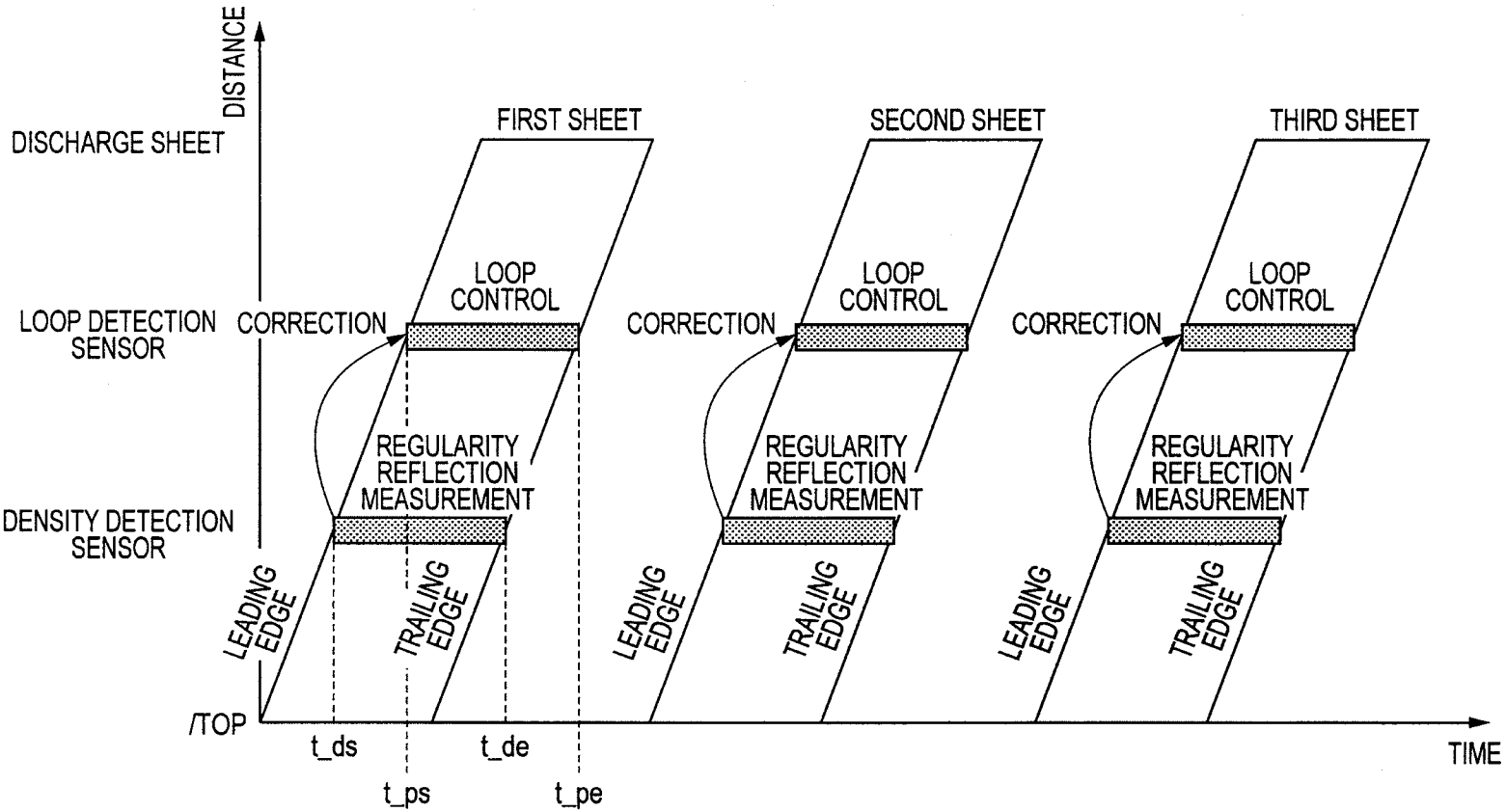
FIG. 6 is a sequence diagram illustrating timing of regularity reflection amount measurement and timing of a loop control.

For detection by respective sensors and correction of the detected values, the detection timing and correction timing are adjusted so that the correction is performed at a predetermined position in the toner image or in the transfer material corresponding to a position in a virtual transfer material or a transfer material assuming a virtual leading edge of the transfer material (to be described later) or the leading edge of the transfer material as a reference point. FIG. 6 illustrates timing of detecting the regularity reflection amount by the density detection sensor 40 and timing of loop detection and timing of loop control on the transfer material by the loop detection sensor 50 in forming images for three sheets of transfer materials. The abscissa represents time course and the ordinate represents the distance from when the image is output (/TOP signal is output) to when the leading edge and the trailing edge of the transfer material are discharged from the image forming apparatus (discharge sheet) through the density detection sensor 40 and the loop detection sensor 50. As shown in FIG. 6, the time interval of detecting the regularity reflection amount (regularity reflection amount measurement) by the density detection sensor 40 is from the time t_ds when the virtual leading edge of the transfer material of the toner image on the intermediate transfer belt 10 reaches the density detection sensor 40 based on the /TOP signal to the time t_de when the virtual trailing edge of the transfer material passes through the density detection sensor 40. Here, the timing chart of FIG. 6 illustrates an outline, and relationship between the time t_ds, the time t_de and the like depends on the physical relationship and the like of the density detection sensor 40 and the loop detection sensor 50.

Here, the /TOP signal is a timing signal for determining the image position on the transfer material in causing the scanners 1*a*-1*d* to perform exposure, and the timing (position) corresponding to the leading edge of the transfer material arrives after the output of the /TOP signal. In the case of a bordered print, timing corresponding to the leading edge of the transfer material comes between the /TOP signal and timing of starting the image drawing. On the other hand, in the case of a borderless print, since the image space is bigger than the outer edge of the transfer material, the timing of starting the image drawing comes between the /TOP signal and the timing corresponding to the leading edge of the transfer material. Here, the position corresponding to the leading edge of the transfer material on the toner image after the primary transfer and before the secondary transfer is defined as virtual leading edge of the transfer material. Similarly, the position corresponding to the trailing edge of the transfer material on the toner image is defined as virtual trailing edge of the transfer material.

Figure 7:
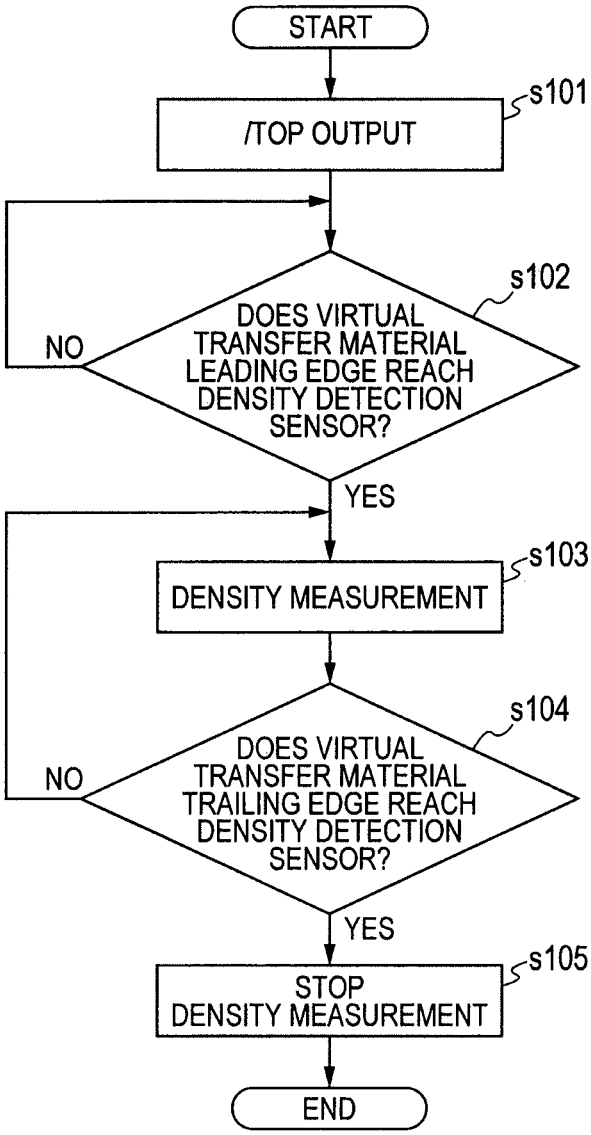
FIG. 7 is a flow chart describing a density measurement process.

FIG. 7 is a flow chart illustrating a specific regularity reflection amount detection (density measurement) process executed by the control part 600. When the image forming engine 620 receives a command to start image formation in response to an instruction from the controller 650, the control part 600 starts the process shown in FIG. 7. In step 101 (hereinafter, described as s101), the control part 600 outputs the /TOP signal via the video interface 640 to request to output an image from the controller 650. In s102, the control part 600 waits for the virtual leading edge of the transfer material of the toner image on the intermediate transfer belt 10 to reach the density detection sensor 40 in response to an inner timer, based on the output of the /TOP signal. In s102, when the control part 600 determines that the virtual leading edge of the transfer material reached the density detection sensor 40, it saves density information/density value of the image obtained from the density detection sensor 40 in the RAM 602 in s103 until the virtual trailing edge of the transfer material reaches the density detection sensor 40 (s104). That is to say, under the instruction of the control part 600, the density measurement of the toner image is performed by the control part 600 using the density detection sensor 40. When the control part 600 determines that the virtual trailing edge of the transfer material reached the density detection sensor 40 in s104, it stops the density measurement in s105.

As shown in FIG. 6, under the instruction of the control part 600, the loop detection part 611 performs a loop amount detection process by the loop detection sensor 50 from the time t_ps when the leading edge of the transfer material reaches the loop detection sensor 50 based on the /TOP signal to the time t_pe when the trailing edge of the transfer material passes through the loop detection sensor 50.

Figure 8A:
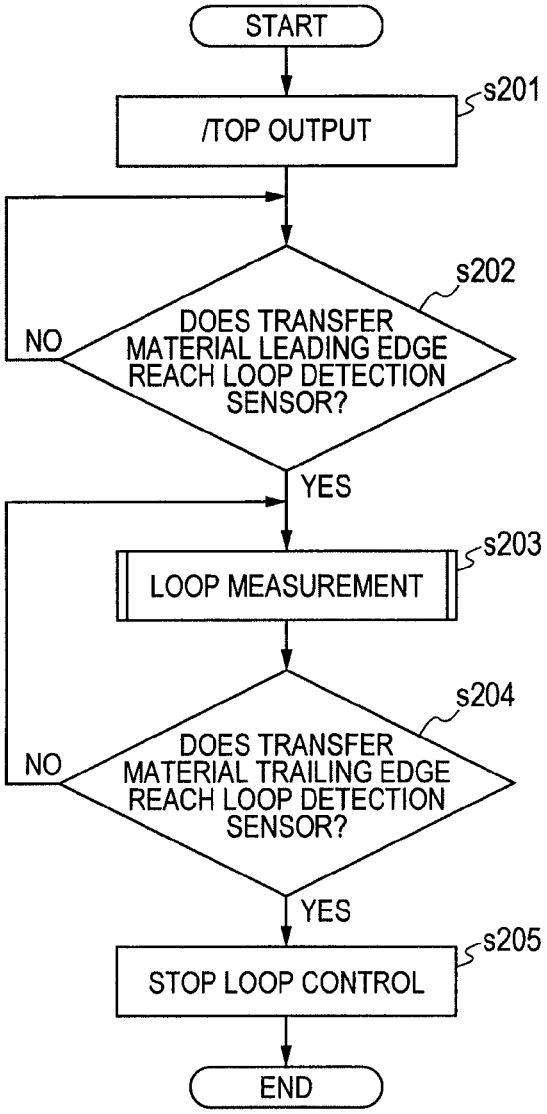
FIGS. 8A and 8B are flow charts describing a loop control process.
Figure 8B:
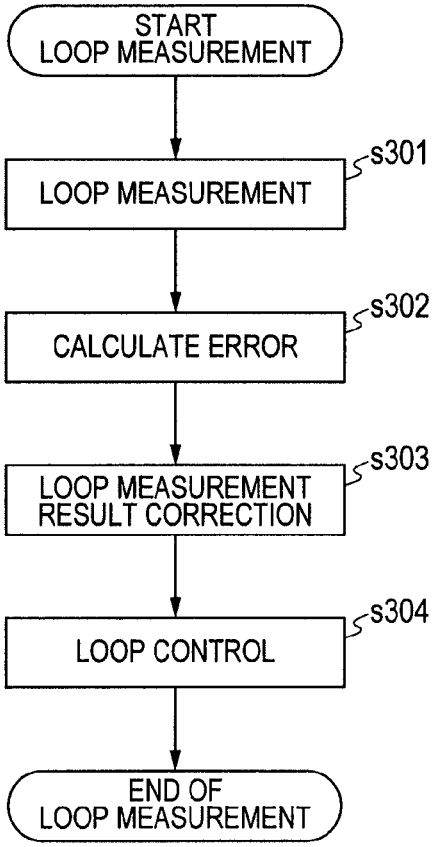

FIGS. 8A and 8B are flow charts illustrating a specific loop control process executed by the control part 600. In s201, similar to s101 in FIG. 7, the control part 600 outputs the /TOP signal, and in s202, waits for the leading edge of the transfer material to reach the loop detection sensor 50 in response to the inner timer based on the /TOP signal. In s202, when the control part 600 determines that the leading edge of the transfer material reached the loop detection sensor 50, it performs the loop amount measurement process in s203 until the trailing edge of the transfer material to reach the loop detection sensor (s204). In s204, when the control part 600 determines that the trailing edge of the transfer material reached the loop detection sensor 50, it stops the loop control in s205. The loop amount measurement process performed in s203 is a process of feeding back the density measurement result obtained by the density detection sensor 40 in s103 of FIG. 7 to the loop detection. The process will be specifically described later.

[About Method of Correcting the Detection Result by Loop Detection Sensor: FIG. 9A to 9D]

Figure 9A:
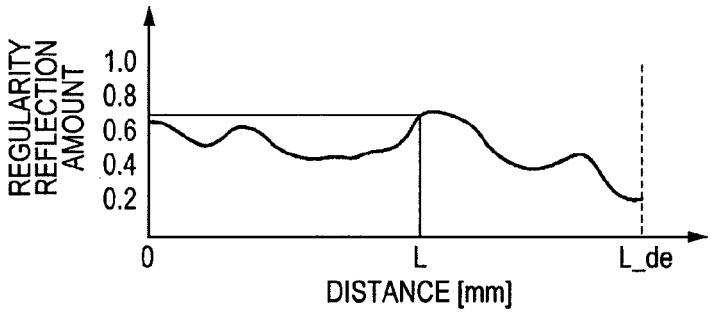
FIGS. 9A, 9B, 9C and 9D are graphs describing a correction on the loop detection sensor.

FIG. 9A is a graph illustrating a relationship between the distance (mm) along the toner image from the virtual leading edge of the transfer material as the origin represented by the abscissa and the regularity reflection amount of the image detected by the density detection sensor 40 represented by the ordinate. Here, the virtual leading edge of the transfer material is assumed as a reference point 0, and the virtual trailing edge of the transfer material is assumed as L_de. Incidentally, FIGS. 9A to 9D are described in the case of a borderless print, and that is why the toner image starts from the virtual leading edge of the transfer material. In FIG. 9A, the detection result by the density detection sensor 40 for the distance L, for example, is about 0.7 V. FIG. 9A is the same as the information (detection result by the density detection sensor 40) saved in the RAM 602 in s103 of FIG. 7.

Figure 9B:
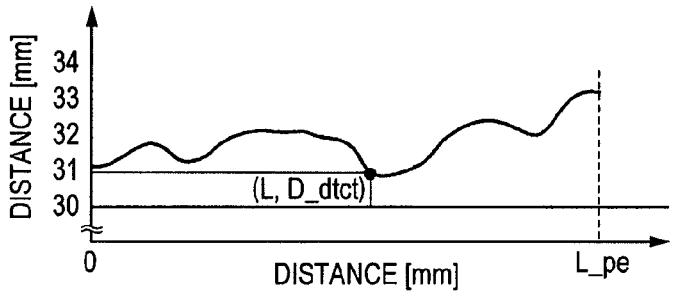

FIG. 9B is a graph illustrating a relationship between the distance (mm) along the transfer material represented by the abscissa and the distance from the loop detection sensor 50 to the transfer material (i.e., corresponding to the loop amount of the transfer material) (mm) represented by the ordinate. Here, the leading edge of the transfer material is assumed as 0 and the trailing edge of the transfer material is assumed as L_pe (=L_de). FIG. 9B is an example in which the measurement is performed with the distance to the transfer material kept constantly mm for describing the influence of the regularity reflection amount from the image on the transfer material on the loop detection sensor 50. As shown in FIG. 9B, although the detection result of the loop detection sensor should have been constantly 30 mm regardless of the distance along the transfer material, errors occur in the distance to the transfer material as a result of an influence of the regularity reflection amount of the image on the loop detection sensor 50. The distance to the transfer material based on the detection result by the loop detection sensor 50 at the distance L from the reference point is, for example, 31 mm.

Figure 9C:
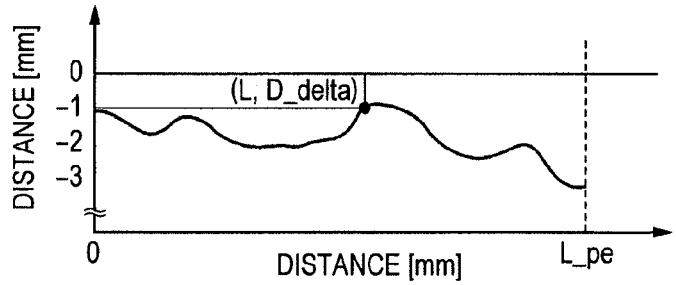

Then, from FIG. 9A to FIG. 9B, the misregister amount in the distance (loop amount) resulted from the influence of the regularity reflection amount from the image is obtained for each distance along the transfer material from the leading edge of the transfer material 0 to the trailing edge of the transfer material L_pe. Then, the value necessary to correct the misregister amount of the distance (loop amount) (hereinafter, called correction distance) is obtained. FIG. 9C is a graph illustrating a relationship between the distance (mm) along the transfer material from the leading edge of the transfer material 0 represented by the abscissa and the correction distance (mm) for the loop detection sensor 50 obtained from the density (detection result of the density detection sensor 40) at the distance represented by the ordinate. For example, as shown in FIG. 9B, the distance (loop amount) should have been 30 mm at the distance L, but it is 31 mm, with misregistration of +1 mm, as a result of an influence of the regularity reflection amount from the image. Therefore, the correction distance at the distance L is −1 mm. Here, since the loop detection sensor 50 is disposed at a certain distance (for example, the above-mentioned 30 mm) from the transfer material, the correction distance is obtained by control part 600 using a table indicating correspondence between the density and the error. Alternatively, the control part 600 may be adapted to multiply a coefficient according to the density based on the density corresponding to the detection result obtained by the loop detection sensor 50.

Figure 9D:
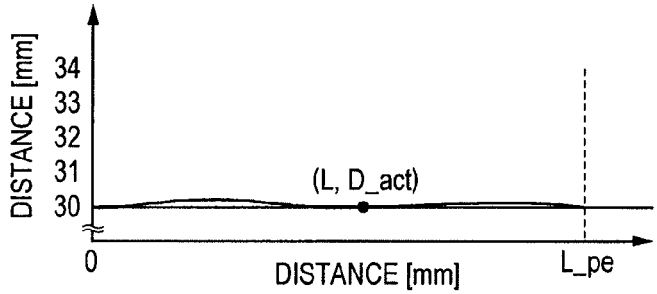

FIG. 9D is a graph illustrating a relationship between the distance (mm) along the transfer material represented by the abscissa and the corrected distance to the transfer material (information indicating the loop amount) (mm) represented by the ordinate from the leading edge of the transfer material 0 to the trailing edge of the transfer material L_pe. The control part 600 adds the correction value for the loop detection sensor 50 obtained from the density in FIG. 9C (correction distance) (D_delta of the distance L) to the measured value by the loop detection sensor 50 obtained in FIG. 9B (D_dtct of the distance L). That enables the loop control part 610 to calculate the correct distance to the transfer material (information indicating the loop amount) (D_act of the distance L) with the misregister amount included in the detection result by the loop detection sensor 50 corrected.

FIG. 8B is a flow chart describing a specific loop control process executed based on the process of the control part 600 in s203 in FIG. 8A. In s301, the loop detection part 611 measures the distance to the transfer material, i.e., information indicating the loop amount at the time point with the loop detection sensor 50 based on an instruction from the control part 600. In s302, the control part 600 calculates an error (misregister amount) by the loop detection sensor 50 from the density information (detection result of the density measurement) by the density detection sensor 40 saved in the RAM 602 in s103 in FIG. 7. In s303, the control part 600 performs the formula (1) below and cancels the influence of the image regularity reflection amount on the loop detection sensor 50, i.e., performs the correction process on the loop amount measurement result measured in s301.

$$D_act[L]=D_dtct[L]+D_delta[L] \quad \text{formula (1)}$$

Here, D_dtct[L] is the distance (loop amount) to the transfer material including the misregister amount measured by the loop detection sensor 50 at the distance L along the transfer material (see FIG. 9B). D_delta[L] is a correction distance for correcting an error included in the detection result by the loop detection sensor 50 calculated based on the result obtained from the density measurement by the density detection sensor 40 at the distance L. Here, the time interval from the timing when the /TOP signal is output to when the virtual leading edge of the transfer material passes under the density detection sensor 40 is previously determined. Therefore, D_delta[L] in the formula (1) is a correction distance obtained corresponding to the density detection result detected when the intermediate transfer belt 10 moved by the distance L after the virtual leading edge of the transfer material having passed under the density detection sensor 40. The correction distance D_delta[L] is calculated from the density measurement results stored in the RAM 602 obtained in s103 of FIG. 7, the ROM 601, and the information of FIG. 5C stored in the ROM 601. D_act[L] is a correct distance (loop amount) to the transfer material that is D_dtct[L] at the distance L corrected from the density measurement result. For example, at the distance L, D_dtct=31 mm, D_delta=−1 mm, therefore, from the formula (1), D_act=30 mm. Then in s304, the control part 600 performs the loop control so that the transfer material forms an appropriate loop by speeding up or down the drive motor 6 via the motor control part 615 based on the loop amount information corrected in s303.

According to the embodiment, the accuracy of the loop amount detection can be improved by the loop amount detection at least with the dependency on the density and tone of the transfer material mitigated. In addition, since the accuracy of the loop amount detection is improved, more accurate loop control can be performed consequently.

The first embodiment has been described about a configuration in which the loop detection sensor 50 is mounted to the image forming surface side. According to requirements such as the space to be disposed, the loop detection sensor 50 may be mounted to the non-image forming surface side instead of mounted to the image forming surface side. The second embodiment will be described about a configuration in which an error by the loop detection sensor 50 obtained from the regularity reflection amount detected by the density detection sensor 40 is corrected even in the case where the loop detection sensor 50 is mounted to the non-image forming surface side.

Figure 10:
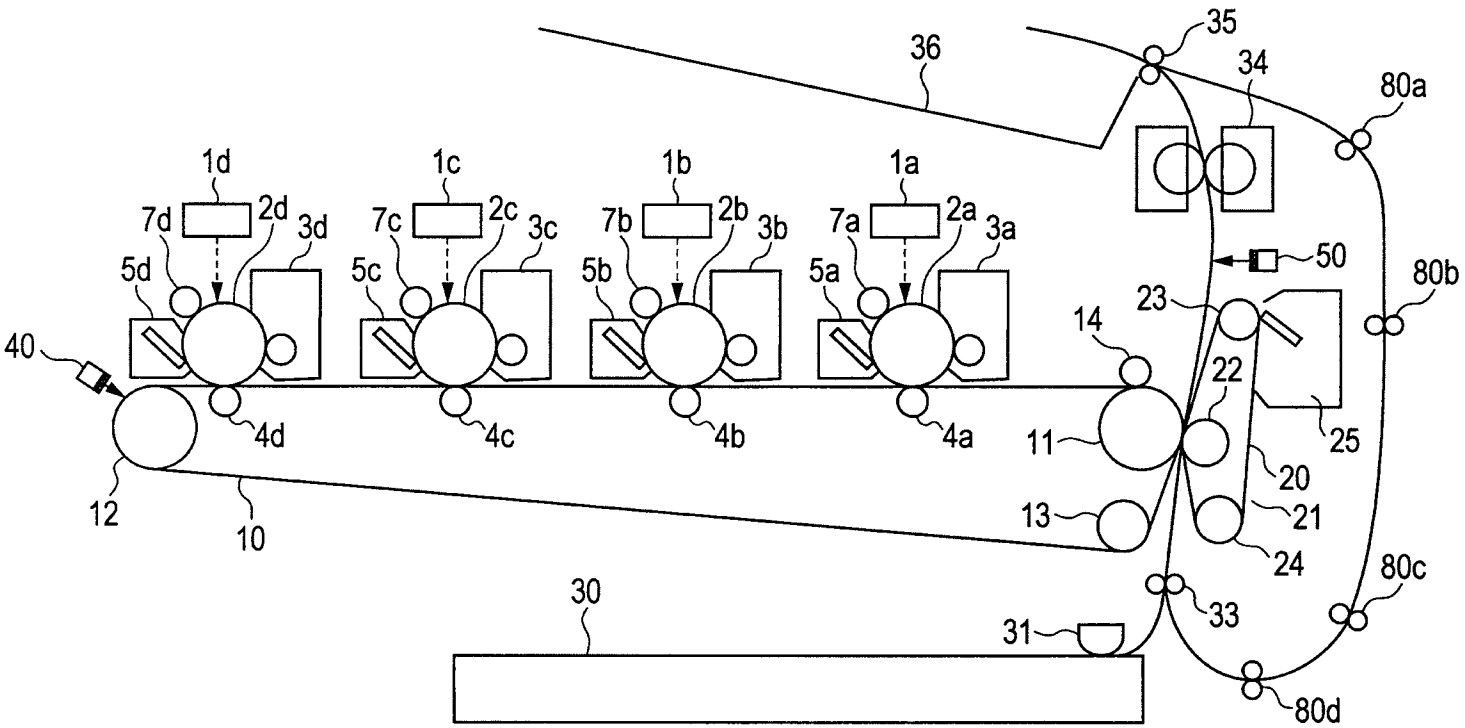
FIG. 10 is a schematic diagram of the image forming apparatus.

[Description of Configuration of Image Forming Apparatus: FIG. 10]

FIG. 10 is a detail drawing of the image forming apparatus in the embodiment. Here, in the embodiment, detailed description is omitted about the matters described in the first embodiment, and the devices and units with the same functions bear the same reference numbers in the drawings. Unlike the first embodiment, the embodiment has the loop detection sensor 50 mounted to the non-image forming surface side instead of mounted to the image forming surface side. Here, the image forming surface side means the side of the surface on which the image is formed of the transfer material that has the image formed on one side, and is also referred to as the top surface side. The non-image forming surface side means the side of the surface on which the image is not formed of the transfer material that has the image formed on one side, and is also referred to as the back surface. In addition, in the embodiment, double-sided conveyance parts 80*a*, 80*b*, 80*c* and 80*d* (hereinafter, merely referred to as 'double-sided conveyance part 80') are mounted as a double-sided conveyance unit for feeding the transfer material 30 to the secondary transfer part 20. The double-sided conveyance part 80 reverses the transfer material that has an image fixed on one side by the fixing part 34 and is partly discharged by the pair of discharging rollers 35, and has the reversed transfer material enter a secondary transfer nip part again for the secondary transfer on the back surface thereof. With the double-sided conveyance part, the image forming apparatus is adapted to be capable of double-sided image formation.

Figure 11:
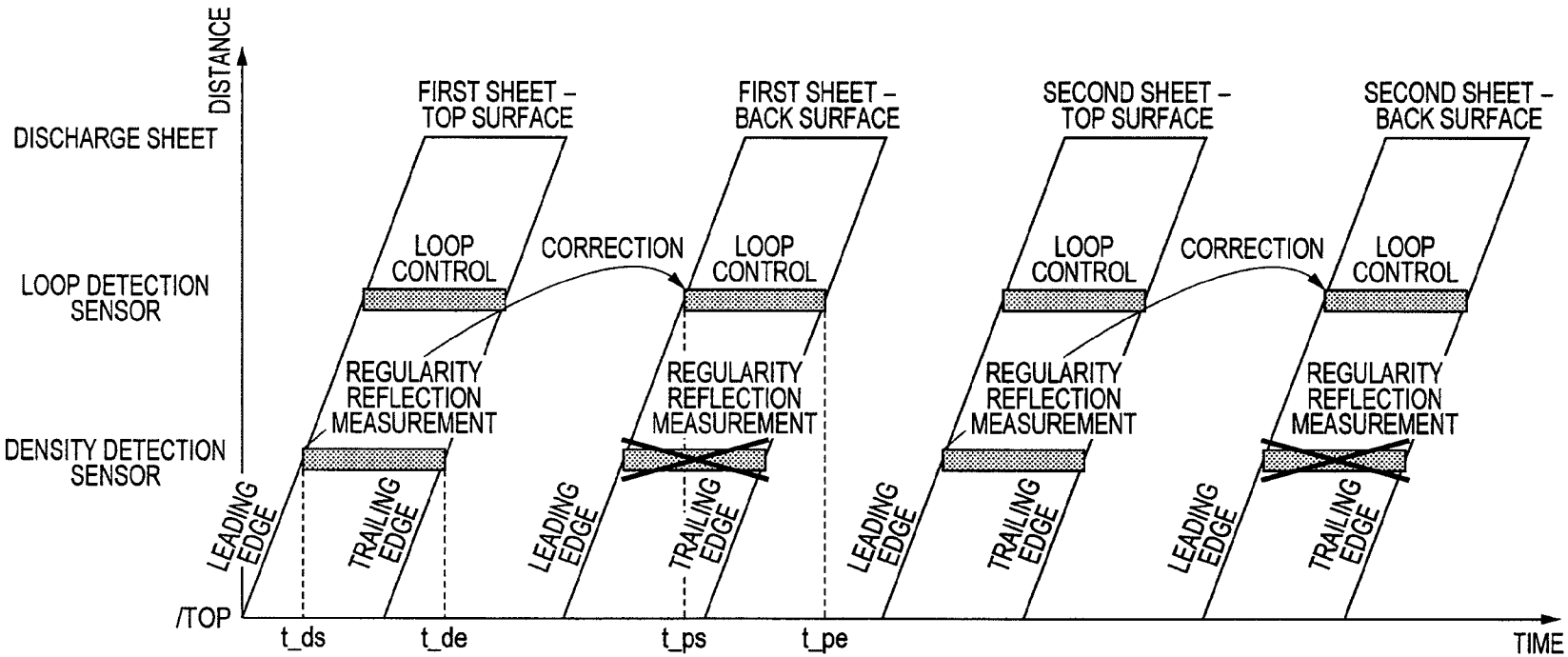
FIG. 11 is a sequence diagram illustrating timing of the regularity reflection amount measurement and timing of the loop control.

[About Timing of Correcting Loop Detection Sensor: FIG. 11]

FIG. 11 illustrates timing of the regularity reflection amount measurement of the image by the density detection sensor 40 and timing of the loop detection, i.e., the loop control on the transfer material by the loop detection sensor 50. Unlike the first embodiment, however, the figure shows the double-sided image formation performed on two sheets of the transfer material. The abscissa represents time course and the ordinate represents the distance from when the image is output (/TOP) to when the leading edge and the trailing edge of the transfer material are discharged from the image forming apparatus through the density detection sensor 40 and the loop detection sensor 50. Here, the timing chart of FIG. 11 illustrates an outline, and relationship between the time t_ds, the time t_de and the like depends on the physical relationship and the like of the density detection sensor 40 and the loop detection sensor 50. As shown in FIG. 11, the regularity reflection amount detection (density measurement) by the density detection sensor 40 is performed from the time tds when the virtual leading edge of the transfer material of the toner image on the intermediate transfer belt 10 reaches the density detection sensor 40 based on the /TOP signal for the top surface (the first surface) of the first sheet to the time t_de when the virtual trailing edge of the transfer material passes through the density detection sensor 40. Then, the detection result by the density detection sensor 40 is stored in the RAM 602, a storage unit, as density information of the image on the top surface (the first surface) of the first sheet. Here, in the embodiment, since the loop detection sensor 50 is mounted to the non-image forming surface side and detects the back surface (the second surface) of the first sheet on which no image has been formed yet, the loop detection sensor 50 is not influenced by the regularity reflection amount from the top surface of the first sheet. Therefore, the correction process is not needed for the loop amount result detected by the loop detection sensor 50 when the first sheet reaches the loop detection sensor 50. After the secondary transfer of the image to the back surface of the first sheet, however, the loop detection sensor 50 detects the back surface of the back surface of the first sheet, i.e., the top surface on which an image has already been formed, therefore, the loop detection sensor 50 is influenced by the regularity reflection amount from the top surface of the first sheet in the loop control. For this reason, the correction process by the loop detection sensor 50 is needed for the loop amount control performed during the secondary transfer of the toner image to the back surface of the first sheet of the transfer material 30 by the secondary transfer part 20.

Therefore, the loop detection by the loop detection sensor 50 during the secondary transfer to the back surface of the first sheet is performed from the time t_ps when the leading edge of the transfer material reaches the loop detection sensor 50 based on the /TOP signal for the back surface of the first sheet to the time t_pe when the trailing edge of the transfer material passes through the loop detection sensor 50 (FIG. 11). At this moment, the density information stored in the RAM 602, which is the regularity reflection amount detected from the top surface of the first sheet from the time t_ds to the time t_de, is used as the detection result by the density detection sensor 40 to be used in the loop correction.

[About Method of Correcting the Loop Detection Sensor]

The method of correcting the loop detection sensor 50 in the embodiment is the same as that has been described in the first embodiment. The exceptions are that the above-mentioned correction timing is the loop control timing for the back surface of the transfer material and that regularity reflection amount information by the density detection sensor 40 to be used in correcting the loop detection sensor 50 is the information on the top surface. For this reason, in the density measurement process shown in FIG. 7, the control part 600 also performs determination on whether the image reached the density detection sensor 40 in s102 is to be transferred to the top surface or the back surface. Only when it is determined that the reached image is to be transferred to the top surface in s102 of FIG. 7, the control part 600 causes the density detection sensor 40 to perform the density measurement (regularity reflection amount measurement) in s103 and saves the result in the RAM 602. Also, in FIG. 8B, after the loop detection part 611 performed the loop measurement in s301, the control part 600 determines whether the transfer material reached the loop detection sensor 50 has the image formed on the top surface or on the back surface. Only when it is determined that the reached transfer material has the image formed on the back surface, the control part 600 calculates the error by using the density measurement result obtained in s103 of FIG. 7 in s302, and corrects the loop measurement result in s303. Specifically, the control part 600 corrects the loop amount based on the density information stored in the RAM 602, while performing the secondary transfer of the toner image to the back surface (the second surface) of the transfer material that is conveyed from the double-sided conveyance part 80 with the toner image formed on the top surface (the first surface). On the other hand, when it is determined that the transfer material has the image formed on the top surface, the control part 600 only performs the loop amount measurement in s301 and the loop control in s304, skipping the error calculation in s302 and the correction of the error in the loop amount measurement result in s303 of FIG. 8B.

As such, according to the embodiment, even if an optical loop detection sensor 50 is mounted to the non-image forming surface side due to such requirements as the space to be disposed, the accuracy of the loop amount detection can be improved by performing the loop amount detection at least with the dependency on the density and tone of the transfer material mitigated. In addition, since the accuracy of the loop amount detection is improved, more accurate loop control can be performed consequently.

Figure 12:
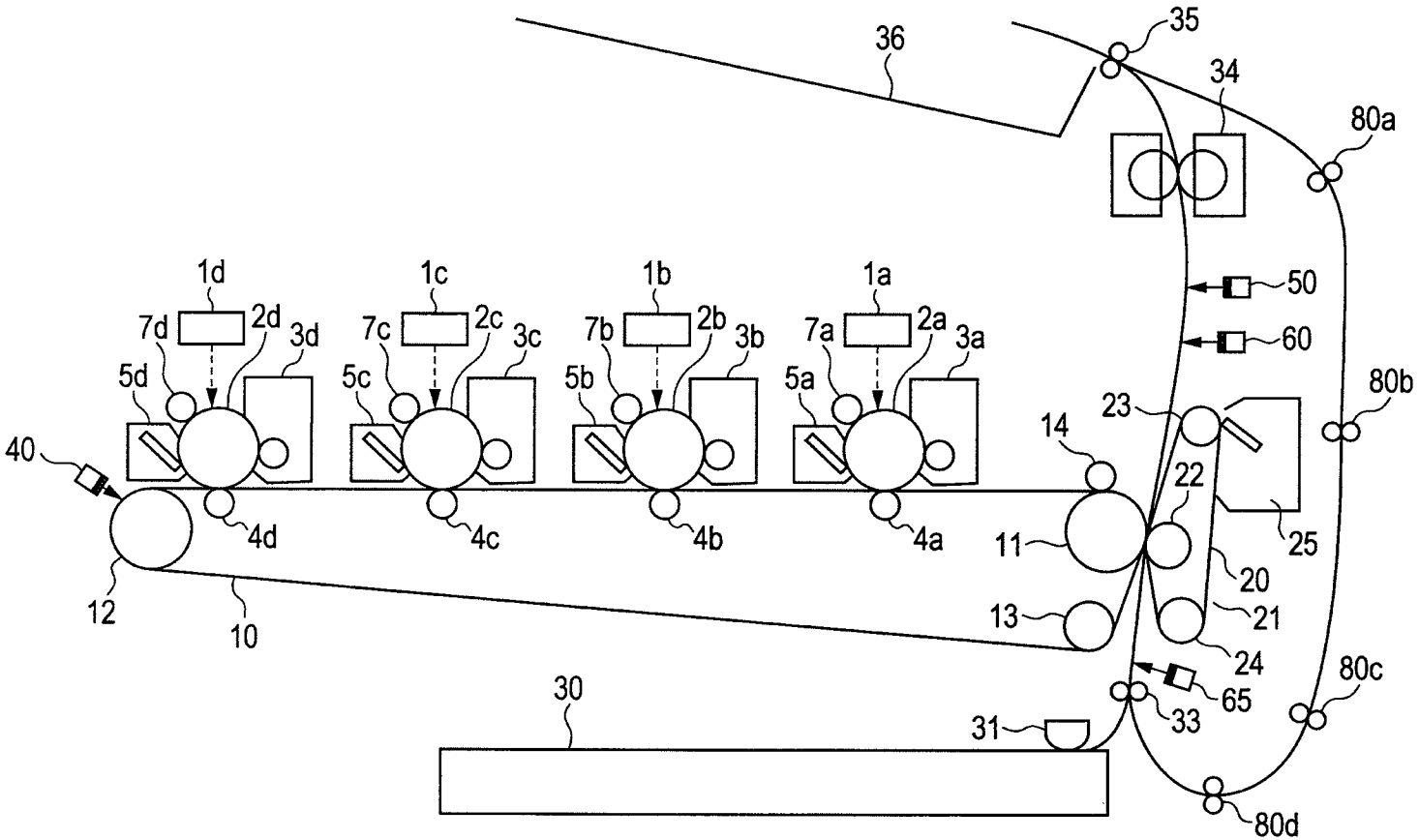
FIG. 12 is a schematic diagram of the image forming apparatus.

[Description of Configuration of Image Forming Apparatus: FIG. 12]

FIG. 12 is a diagram illustrating a configuration of the image forming apparatus according to the third embodiment; hereinafter, the same components as those of the second embodiment will be denoted by the same reference numbers and description thereof will be omitted. The components which differ from those of the second embodiment will be described. The embodiment includes a color value detection sensor 60 and a glossiness detection sensor 65 as detection units disposed upstream of the loop detection sensor 50.

[Description of Loop Detection Sensor: FIG. 2A to FIG. 2C]

The loop detection sensor 50 has a configuration shown in FIGS. 2A to 2C as described in the first and second embodiments. In the loop detection sensor 50, since a change in the regularity reflection amount due to changes in the lightness and glossiness of the image leads to an error in the detection position of each detection device of the PSD, changes in the lightness and glossiness from the image on the transfer material causes an error in the distance to the transfer material.

Figure 13A:
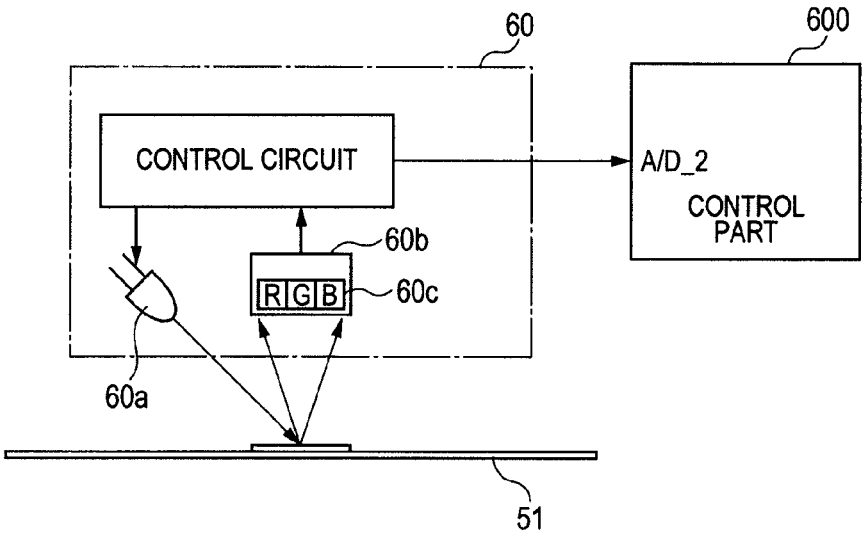
FIG. 13A is a schematic diagram illustrating a color value detection sensor.

[Description of Color Value Detection Sensor: FIG. 13A]

The color value detection sensor 60, disposed upstream of the loop detection sensor 50 on the transfer material conveyance path, detects the color value of the transfer material or of the image fixed and formed on the transfer material after passing through the double-sided conveyance path and outputs RGB spectrum transmission values. Although the color value detection sensor 60 is disposed between the secondary transfer part 20 and the fixing part 34 in the embodiment, it may be disposed upstream of the secondary transfer part 20.

FIG. 13A illustrates a block diagram of the color value detection sensor 60. The color value detection sensor 60 is constituted by a white LED 60*a* as a light-emitting element and a charge-storage-type sensor 60*b* with an on-chip filter for three colors or more including RGB as a light-receiving element. Light from the white LED 60*a* is incident at an angle of 45 degrees on the transfer material or on the image (hereinafter, called object) 51 that is fixed and formed on the transfer material, and the intensity of diffused reflection light in the 0-degree direction is detected with the charge-storage-type sensor 60*b* with the RGB on-chip filter. The light reception part of the charge-storage-type sensor 60*b* with the RGB on-chip filter has RGB pixels independent of each other like 60*c*. The light-receiving element may also be a photodiode. The light-receiving element may have two or more arrays of three pixels of RGB. It may alternatively be adapted to have the incidence angle of 0 degree and the reflection angle of 45 degrees. Further, it may alternatively be adapted to have the emission parts disposed close to each other with three colors of R, G and B independent of each other so that the RGB emission parts emit at different moments respectively and a sensor having no filter receives the reflection lights. The diffused reflection lights of respective components of RGB detected by the light-receiving element are converted from light into analog electric signals by the control circuit and input into an A/D port A/D_2 of the control part 600. The input analog electric signals are converted by the A/D converter into, for example, 255-gradation digital electric signals. The control part 600 performs respective calculations based on the digital electric signals, and detects color values of the transfer material or the image formed on the transfer material.

Figure 13B:
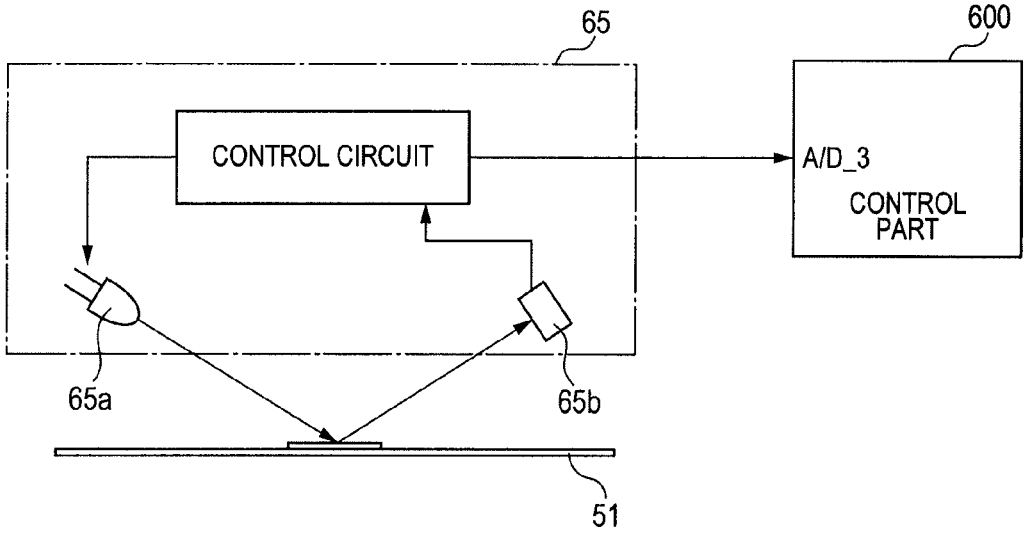
FIG. 13B is a schematic diagram of a glossiness detection sensor.

[Description of Glossiness Detection Sensor: FIG. 13B]

The glossiness detection sensor 65, which is disposed upstream of the loop detection sensor 50 on the conveyance path of the transfer material, detects the regularity reflection amount from the transfer material or the object 51 that is the image fixed and formed on the transfer material having passed through the double-sided conveyance path, and outputs the glossiness. FIG. 13B illustrates a block diagram of the glossiness detection sensor 65. The glossiness detection sensor 65 is constituted by an infrared LED 65*a* as a light-emitting element, a photodiode 65*b* as a light-receiving element, and the like. Light from the infrared LED 65*a* is incident at an angle of 60 degrees on the object 51, and the intensity of regularity reflection light in the 60-degree direction is detected with the photodiode 65*b*. The incidence angle and reflection angle may be any angles. The control circuit controls to convert the regularity reflection light detected by the light-receiving element into analog electric signals and to input the analog electric signals into the A/D port A/D_3 of the control part 600. The analog signals input into the A/D converter are converted into digital electric signals. The control part 600 performs respective calculations based on the digital electric signals, and detects glossiness of the transfer material or the image formed on the transfer material.

Figure 14:
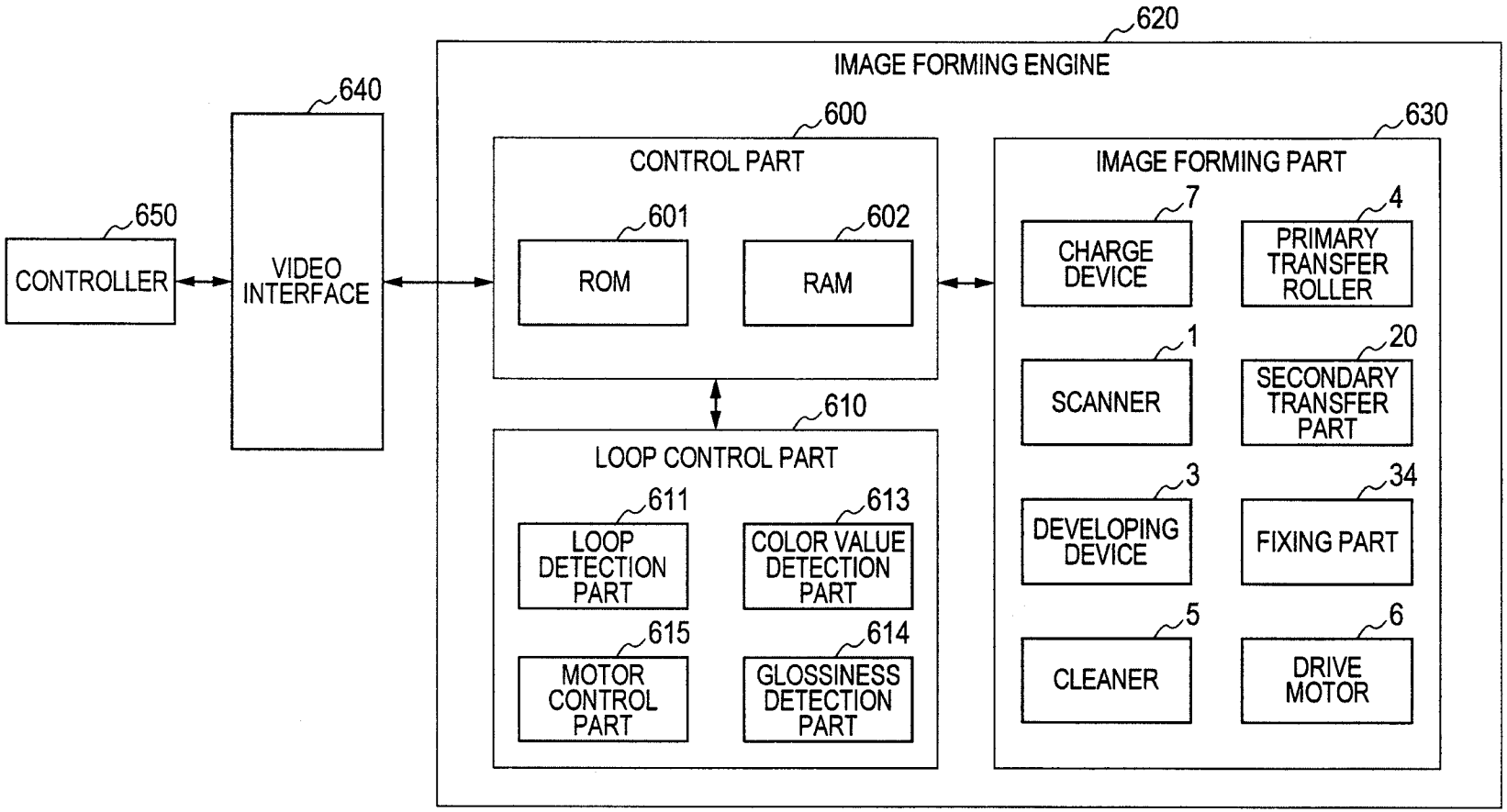
FIG. 14 is a block diagram of the image forming apparatus.

[Description of Block Diagram of Image Forming Apparatus: FIG. 14]

FIG. 14 is a block diagram illustrating a configuration of the control part of the image forming apparatus. Only the components which differ from those shown in FIG. 4 and described in the first and second embodiments will be described, and the same components are denoted by the same reference numbers as those in the above with the description omitted. The loop control part 610 of the embodiment further includes a color value detection part 613 and a glossiness detection part 614 as compared with the loop control part 610 shown in FIGS. 2A to 2C. The color value detection part 613 controls the color value detection sensor 60 that detects the color values of the transfer material or of the image fixed and formed on the transfer material. It corresponds to the control circuit shown in FIG. 13A. The glossiness detection part 614 controls the glossiness detection sensor 65 that detects the glossiness. It corresponds to the control circuit shown in FIG. 13B.

[About Loop Detection Sensor and Lightness Error: FIGS. 15A to 15E]

Figure 15A:
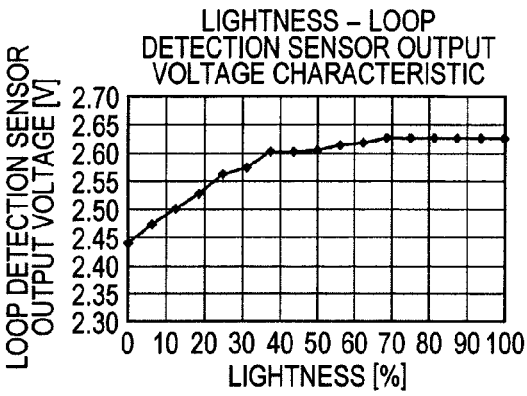
FIG. 15A is a graph illustrating a lightness and output voltage characteristic of the loop detection sensor.
Figure 15B:
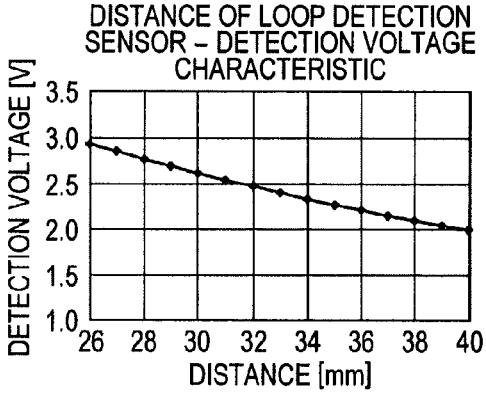
FIG. 15B is a graph illustrating a distance of the loop detection sensor and a detection voltage characteristic.
Figure 15C:
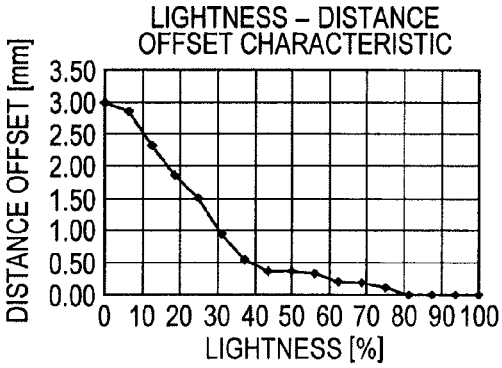
FIG. 15C is a graph illustrating a lightness and distance offset characteristic of the loop detection sensor.

Since the loop detection sensor 50 is influenced by the lightness of the transfer material or of the image formed on the top surface of the transfer material, the value detected by the loop detection sensor 50 includes an error according to the lightness. FIGS. 15A to 15E show information stored in the ROM 601 of the image forming apparatus that is used by the control part 600 in correcting the occurred error. FIG. 15A is a graph in which the abscissa represents the lightness and the ordinate represents the detection results of the loop detection sensor 50 where the distance between the loop detection sensor 50 and the transfer material is constant (for example, 30 mm). As shown in FIG. 15A, the voltage value obtained from the loop detection sensor 50 decreases as the lightness decreases. In general, since the color becomes closer to black as the lightness decreases and closer to white as the lightness increases, the abscissa of FIG. 15A illustrates that the color becomes closer to white as the lightness increases. It is assumed that the lightness of 100% indicates white, i.e., the state in which no image has been formed on the transfer material and thus the loop detection sensor 50 can provide a correct distance. FIG. 15B illustrates output (detected) voltage characteristics against the distance to a measured object (object 51) of the loop detection sensor 50. FIG. 15C illustrates the distance detection error by the loop detection sensor 50 against the lightness from FIG. 15A and FIG. 15B, showing that there is a difference about 3 mm between the minimum value and the maximum value of the lightness. In FIG. 15C, the value of the distance obtained under the lightness of 100% is set to the reference point by assuming that the distance is correct, and the distances under the other luminosities are shown as distance offsets (mm) with respect to the reference point.

In order to correct the lightness–distance characteristics of the loop detection sensor 50, the control part 600 calculates the lightness in the method shown below from the color value data detected by the color value detection sensor 60. First, the control part 600 calculates the XYZ tristimulus values from the RGB values detected by the color value detection sensor 60 by using the formula (2).

$$\begin{pmatrix} X \\ Y \\ Z \end{pmatrix} = \begin{pmatrix} Xr & Xg & Xb \\ Yr & Yg & Xb \\ Zr & Zg & Zb \end{pmatrix} \begin{pmatrix} R \\ G \\ B \end{pmatrix} \qquad \text{formula (2)}$$

In the array of the formula (2), Xr-Zb are eigenvalues of the color value detection sensor 60 and constituted by optimal constants according to the sensor used. Next, the control part 600 converts the XYZ values calculated by the formula (2) into L*a*b colorimetric system and calculates the lightness L. For the calculation of the lightness L in the L*a*b colorimetric system, the formula (3) is used. Here, Y is a tristimulus value in the XYZ tristimulus values and Yw is an eigenvalue of the color value detection sensor 60.

$$L=116\times(Y/Yw)\hat{}(1/3)-16 \qquad \text{formula (3)}$$

The above-mentioned method of converting the color values into the lightness is merely an example, and other methods may be used for calculating the lightness from the color values. It may also be adapted to omit the correction on the detection error made by the loop detection sensor 50 when the detected values of RGB satisfy the conditions of formulas (4)-(6), by determining that the detection error made by the loop detection sensor 50 is slight because the lightness is higher than the desired value. Here, Xa is an eigenvalue that is set according to the color value detection sensor 60 used.

$$R>Xa \qquad \text{formula (4)}$$

$$G>Xa \qquad \text{formula (5)}$$

$$B>Xa \qquad \text{formula (6)}$$

As mentioned above, the control part 600 converts the color values detected by the color value detection sensor 60 into the lightness, and corrects the error included in the result detected by the loop detection sensor 50. The control part 600 can calculate the correct distance to the transfer material by correcting the error in the distance to the transfer material detected by the loop detection sensor 50 shown in FIG. 15C. Accordingly, the control part 600 can perform more accurate loop control on the transfer material via the loop control part 610.

Figure 15D:
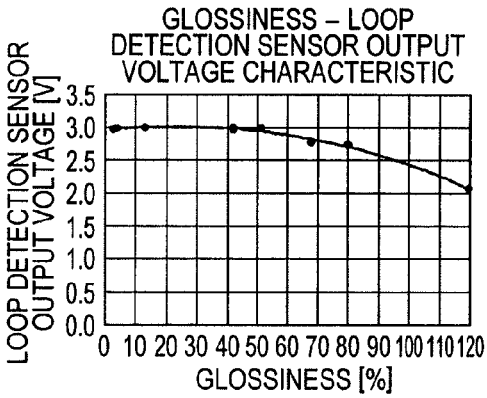
FIG. 15D is a graph illustrating a glossiness and output voltage characteristic of the loop detection sensor.

[About Loop Detection Sensor and Glossiness Error: FIG. 15D]

Figure 15E:
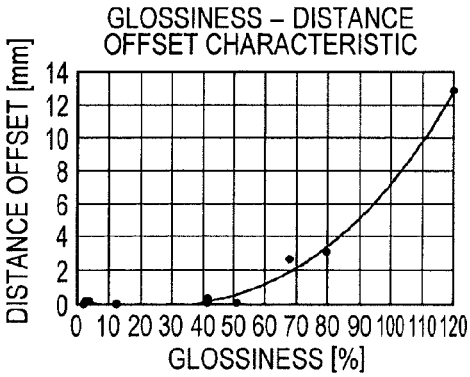
FIG. 15E is a graph illustrating a glossiness and distance offset characteristic of the loop detection sensor.

Since the loop detection sensor 50 is influenced by the glossiness of the transfer material or of the image formed on the top surface of the transfer material, the value detected by the loop detection sensor 50 has an error according to the glossiness of the image. FIG. 15D is a graph in which the abscissa represents the glossiness and the ordinate represents the results detected by the loop detection sensor 50 where the distance between the loop detection sensor 50 and the transfer material is constant (for example, 30 mm). As shown in FIG. 15D, the detection voltage value obtained from the loop detection sensor 50 decreases as the glossiness increases. FIG. 15E illustrates the distance detection error by the loop detection sensor 50 against the glossiness obtained from FIG. 15B and FIG. 15D. In FIG. 15D, the distance obtained from the loop detection sensor 50 under the glossiness of 0% is set to the reference point by assuming that the distance is correct, and the distances under the other glossiness levels are shown as distance offsets (mm) with respect to the reference point. The figure shows that since the typical glossy paper for the image forming apparatus has the glossiness of around 70%, the detection error made by the loop detection sensor 50 due to the influence of the glossiness may be up to about 3 mm. The control part 600 can calculate the correct distance to the transfer material by correcting the error in the distance to the transfer material detected by the loop detection sensor 50 shown in FIG. 15E based on the glossiness detected by the glossiness detection sensor 65. Accordingly, the control part 600 can perform more accurate loop control on the transfer material via the loop control part 610.

[Arrangement of Loop Detection Sensor, Color Value Detection Sensor and Glossiness Detection Sensor: FIG. 3B]

Position to be detected by the color value detection sensor 60 and the glossiness detection sensor 65 and the position for the loop detection by the loop detection sensor 50 are the same as those in the first and second embodiments shown in FIG. 3B.

[About Correction Timing of Loop Detection Sensor: FIG. 16, FIGS. 17A to 17F, and FIG. 18]

Figure 16:
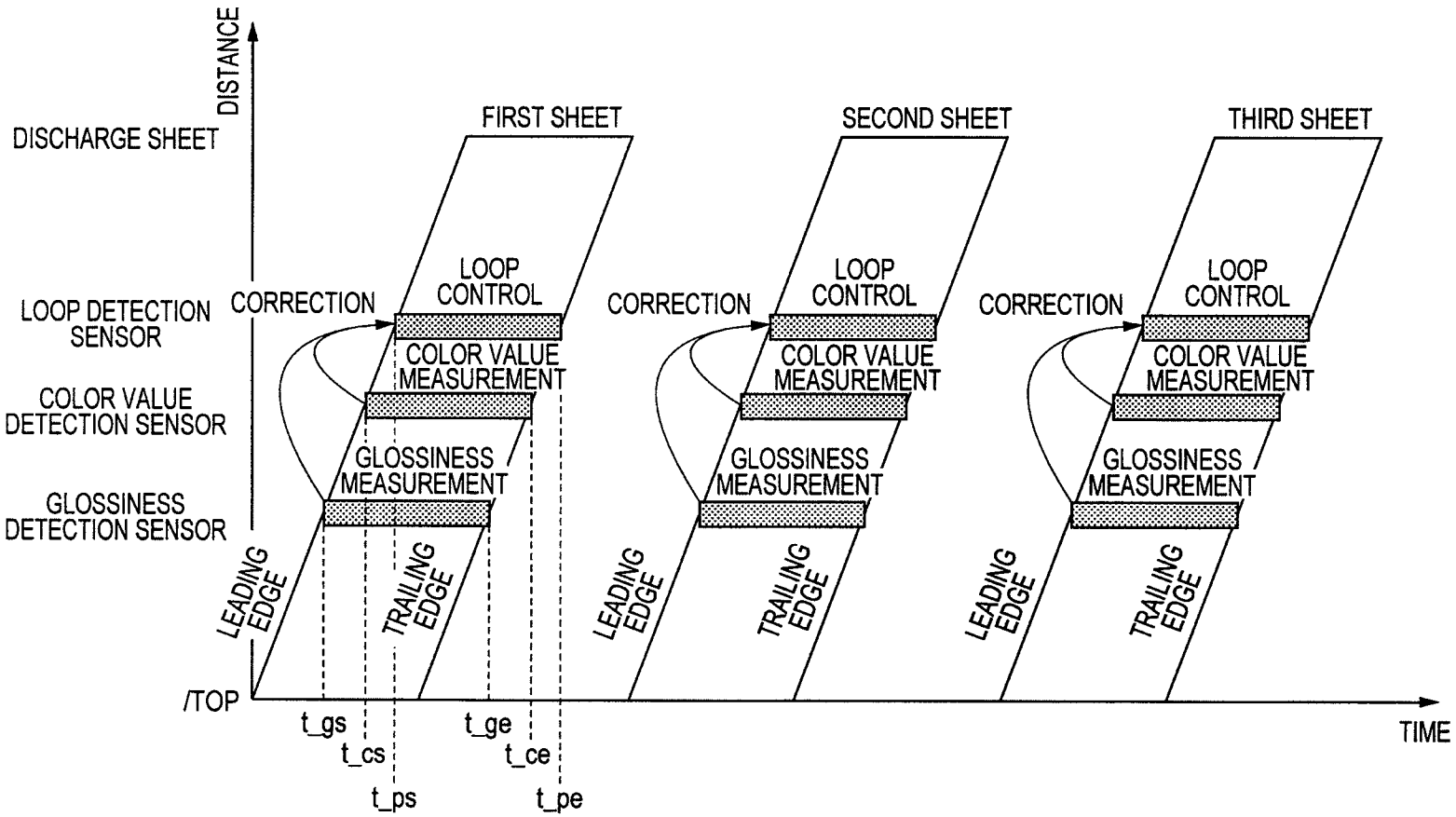
FIG. 16 is a sequence diagram describing color value and glossiness measurements and the loop control.

For the detection correction and loop correction by respective sensors, the control part 600 adjusts the detection timing and correction timing so that the correction control is performed at the same position in the transfer material with the leading edge of the transfer material as a reference point. FIG. 16 illustrates, the lightness detection timing by the color value detection sensor 60, the glossiness detection timing by the glossiness detection sensor 65 and the loop detection timing by the loop detection sensor 50 in forming images for three sheets. The abscissa represents time course and the ordinate represents the distance from when the image is output (/TOP) to when the leading edge and the trailing edge of the transfer material are discharged from the image forming apparatus through the color value detection sensor 60, the glossiness detection sensor 65 and the loop detection sensor 50. Here, the timing chart of FIG. 16 illustrates an outline, and a relationship between the time t_gs, the time t_ge and the like depends on the physical relationship and the like of the loop detection sensor 50, the color value detection sensor 60 and the glossiness detection sensor 65. As shown in FIG. 16, the lightness detection (color value measurement) by the color value detection sensor 60 is performed from the time t_cs when the leading edge of the transfer material reaches the color value detection sensor 60 based on the /TOP signal to the time t_ce when the trailing edge of the transfer material passes through the color value detection sensor 60. Similarly, the glossiness detection (glossiness measurement) by the glossiness detection sensor 65 is performed from the time t_gs when the leading edge of the transfer material reaches the glossiness detection sensor 65 to the time t_ge when the trailing edge of the transfer material passes through the glossiness detection sensor 65.

The image lightness detection process is executed by the control part 600 in the similar manner as that described in FIG. 7. Unlike the process in s102 of FIG. 7, in the process corresponding to that in s102 in the embodiment, the control part 600 waits for the leading edge of the transfer material to reach the color value detection sensor 60 in response to the inner timer. When the control part 600 determines that the leading edge of the transfer material reached the color value detection sensor 60 in the process corresponding to that in s102, it performs the process corresponding to that in s103 until the trailing edge of the transfer material reaches the color value detection sensor 60 in the process corresponding to that in s104. In the process corresponding to that in s103, the control part 600 causes the color value detection sensor 60 to measure the color values of the transfer material via the color value detection part 613, and saves the measurement result (color value/color information) of the color value measurement in the RAM 602. The process of converting the color values into the lightness has been mentioned above. When the control part 600 determines that the trailing edge of the transfer material reached the color value detection sensor 60 in the process corresponding to that in s104, it stops the color value measurement.

The glossiness detection process is also executed in a similar manner as that described in FIG. 7. In the process corresponding to that in s102, the control part 600 waits for the leading edge of the transfer material to reach the glossiness detection sensor 65. When the control part 600 determines that the leading edge of the transfer material has reached the glossiness detection sensor 65 in the process corresponding to that in s102, it performs the glossiness measurement process using the glossiness detection part 614 in the process corresponding to that in s103 until the trailing edge of the transfer material reaches the glossiness detection sensor 65. Here, the control part 600 saves the measurement result of the glossiness (glossiness information/glossiness value) in the RAM 602. When the control part 600 determines that the trailing edge of the transfer material reached the glossiness detection sensor 65 in the process corresponding to that in s104, it stops the glossiness measurement.

As shown in FIG. 16, the loop detection by the loop detection sensor 50 is performed from the time t_ps when the leading edge of the transfer material of the transfer material reaches the loop detection sensor 50 based on the /TOP signal to the time t_pe when the trailing edge of the transfer material passes through the loop detection sensor 50. The loop control process executed by the control part 600 is the same as that described in FIG. 8. In the embodiment, the lightness detection result obtained from the color value measurement result obtained by the color value detection part 613 and the glossiness detection result obtained by the glossiness detection part 614 are fed back to the loop detection.

Figure 17A:
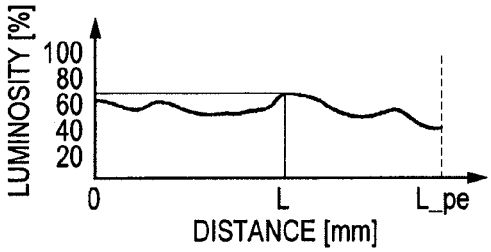
FIGS. 17A, 17B, 17C, 17D, 17E and 17F are graphs describing a correction on the loop detection sensor.
Figure 17B:
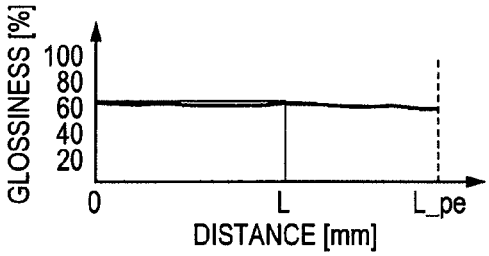
Figure 18:
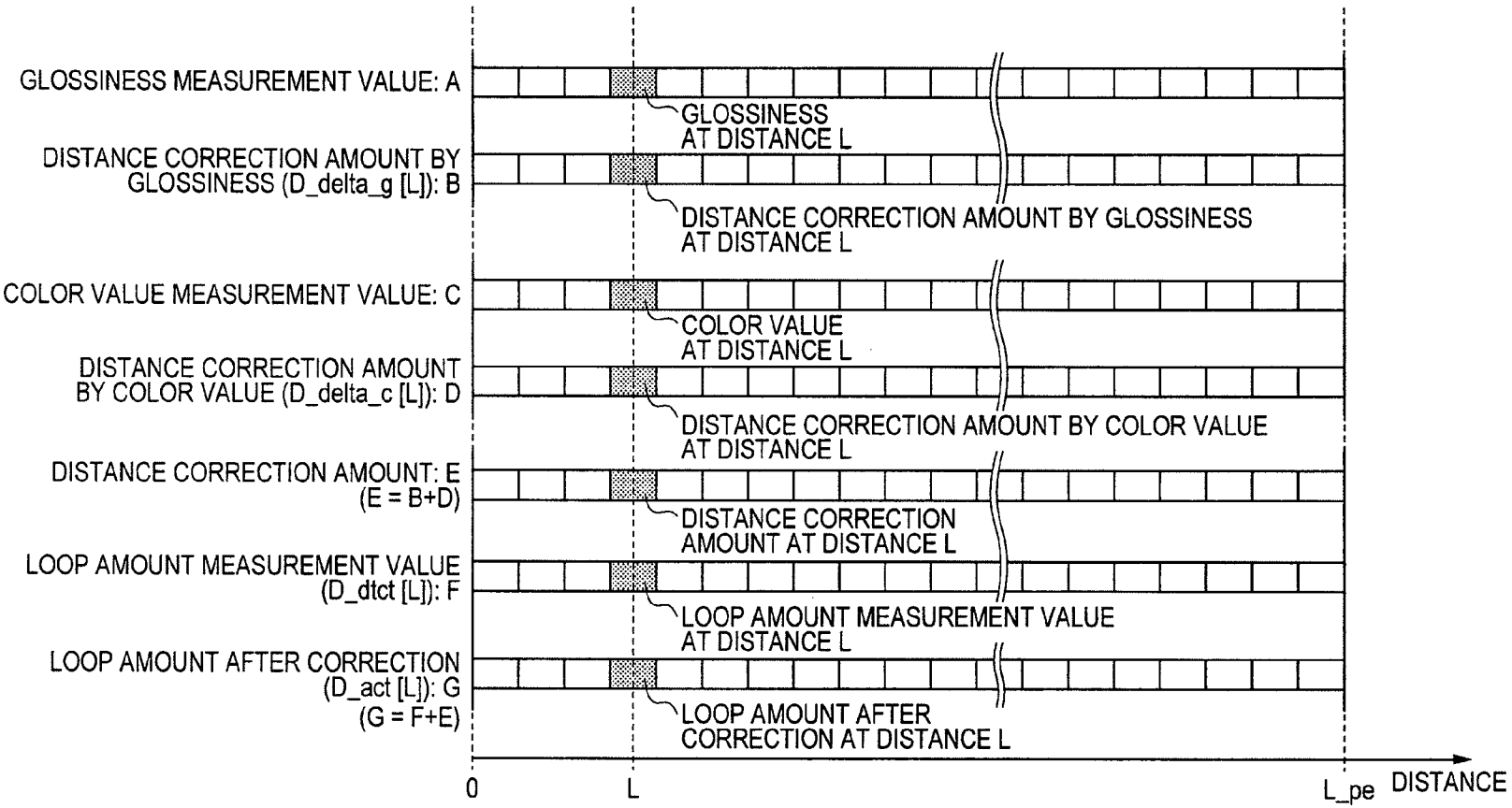
FIG. 18 is a diagram for describing calculations for the loop control.

[About Method of Correcting Loop Detection Sensor: FIGS. 17A and 17B, FIG. 18]

Figure 17C:
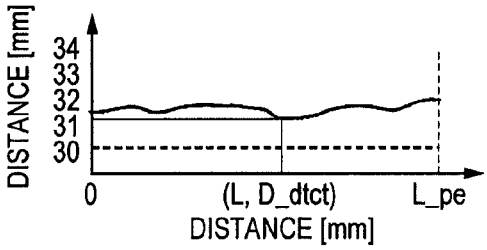

FIG. 17A is a graph illustrating a relationship between the distance [mm] along the transfer material represented by the abscissa and the lightness [%] represented by the ordinate with respect to the range from 0 which is set as the leading edge of the transfer material to the trailing edge of the transfer material L_pe. This relationship diagram is the same as information saved in the RAM 602. FIG. 17B is a graph illustrating a relationship between the distance [mm] along the transfer material represented by the abscissa and the glossiness [%] represented by the ordinate with respect to the range from the leading edge of the transfer material 0 to the trailing edge of the transfer material L_pe. This relationship diagram is the same as information saved in the RAM 602. FIG. 17C is a graph illustrating a relationship between the distance [mm] along the transfer material represented by the abscissa and the distance from the loop detection sensor 50 to the transfer material (i.e., the loop amount of the transfer material) [mm] with respect to the range from the leading edge of the transfer material 0 to the trailing edge of the transfer material L_pe. FIG. 17C is an example in which the distance to the transfer material is kept constantly 30 mm for describing the influence of the color value and glossiness on the loop detection sensor 50. As shown in FIG. 17C, after the loop detection sensor 50 influenced by the image color value and glossiness, it introduces errors in the distance to the transfer material.

Figure 17D:
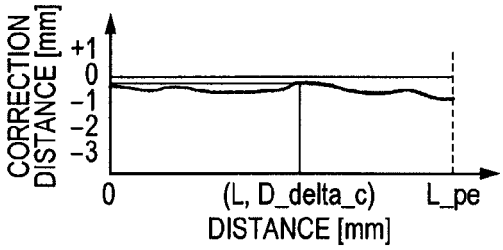
Figure 17E:
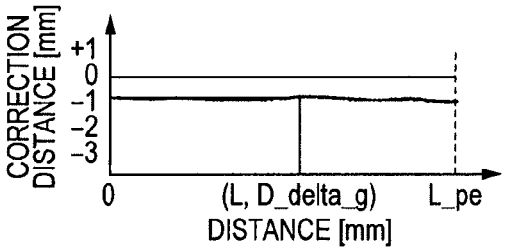
Figure 17F:
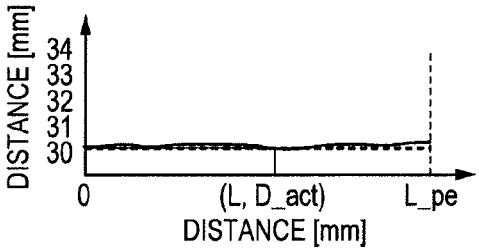

FIG. 17D is a graph illustrating a relationship between the distance along the transfer material represented by the abscissa and the correction distance for the loop detection sensor 50 obtained from the color value at the time represented by the ordinate with respect to the range from the leading edge of the transfer material 0 to the trailing edge of the transfer material L_pe. FIG. 17E is a graph illustrating a relationship between the distance along the transfer material represented by the abscissa and the correction distance for the loop detection sensor 50 obtained from the glossiness at the time represented by the ordinate with respect to the range from the leading edge of the transfer material 0 to the trailing edge of the transfer material L_pe. The ordinates of FIGS. 17D and 17E illustrate the distance 30 mm from the loop detection sensor 50 to the transfer material as the reference point 0. FIG. 17F is a graph illustrating the distance to be detected by the loop detection sensor 50 after the lightness correction and glossiness correction with respect to the range from the leading edge of the transfer material 0 to the trailing edge of the transfer material L_pe, with the abscissa representing the distance along the transfer material and the ordinate representing the distance to the transfer material (loop amount) after the correction. The graph of FIG. 17F illustrates that the correct distance to the transfer material with the error corrected can be calculated by combining the correction value for the loop detection sensor 50 obtained from the color value and glossiness with the measured value of the loop detection sensor 50 obtained in FIG. 17C.

The specific loop control implemented by the control part 600 will be described with reference to FIG. 8B only as regards the processes differing from those in FIG. 8B. In the process corresponding to that in s302, the loop control part 610 calculates the error made by the loop detection sensor 50 from the color value and the glossiness data obtained from the color value detection sensor 60 and the glossiness detection sensor 65, which are saved in the RAM 602. In the process corresponding to that in s303, the loop control part 610 corrects the influences by the color value and glossiness exerted on the loop detection sensor 50 by executing the formula (6) below. The distance [L] indicates the distance L from the leading edge of the transfer material along the transfer material. FIG. 18 schematizes the arithmetic expression of the formula (6), illustrating that the loop control part 610 detects the color value and glossiness at the same position in the conveyance direction of the transfer material and performs the loop control. The detection by the color value detection sensor 60, the glossiness detection sensor 65 and the loop detection sensor 50 may start at the loop control start position in the transfer material conveyance direction instead of at the leading edge of the transfer material.

$$D_act[L]=D_dtct[L]+D_delta_c[L]+D_delta_g[L] \qquad \text{formula (6)}$$

Here, D_dtct[L] is the distance to the transfer material measured by the loop detection sensor 50 (loop amount) in the distance L (see FIG. 17C). D_delta c[L] is the correction distance for the loop detection sensor 50 obtained from the lightness in the distance L (see FIG. 17D). The correction distance is calculated from the lightness stored in the RAM 602 and the lightness–distance error characteristic of FIG. 15C stored in the RAM 602. In addition, D_delta_g[L] is the correction distance for the loop detection sensor 50 obtained from the glossiness in the distance L (see FIG. 17E). The correction distance is calculated from the glossiness stored in the RAM 602 and the glossiness–distance error characteristic of FIG. 15E stored in the ROM 601 and the RAM 602. D_act[L] is the correct distance to the transfer material (loop amount), which is D_dtct[L] in the distance L corrected with the lightness and glossiness.

In the process corresponding to that in s304, from the corrected loop amount, the loop control part 610 performs the conveyance control to provide the transfer material with the optimal loop by speeding up and down the drive motor 6 that drives the fixing part 34. Incidentally, when the correction on the loop amount according to the embodiment is executed, the process of correcting the error lead by the density of the toner image that has been described in the first and second embodiments may be executed.

As such, according to the embodiment, the accuracy of the loop amount detection can be improved by performing the loop amount detection at least with the dependency on the color value and glossiness of the transfer material mitigated. In addition, since the accuracy of the loop amount detection is improved, more accurate loop control can be performed consequently.

Although the loop amount control is performed by using both of the measurement result for the color value and the measurement result for the glossiness in the embodiment, it may be adapted to perform the loop amount control by only using the measurement result for one of the color value and the glossiness. Even with the configuration of performing the loop amount control only for one of the color value and the glossiness, the accuracy of the deflection amount detection can be improved by performing the deflection amount detection at least with the dependency of the image that is formed on the transfer material mitigated.

Other Embodiments

In the first to third embodiments, the loop amount control is performed by calculating measurement errors in the detection results from the loop amount detection sensors led by the density, color value or glossiness, correcting the distance to the transfer material, and reflecting information about the density, color value or glossiness on the control of the rotational speed of the fixing part 34. As another embodiment, the apparatus may be adapted to attain the same effects without correcting the distance to the transfer material. For example, the apparatus may be adapted to perform the loop amount control by controlling the rotational speed of the fixing part 34 based on the information about the error in the detection result from the loop amount detection sensors led by the density, color value or glossiness and the information about the density, color value or glossiness without correcting the distance. Specifically, it may be adapted to perform the loop amount control by directly calculating the amount to change the rotational speed of the fixing part 34 by processing the information about the error in the loop amount that is uniquely determined depending on the information indicating the detected loop amount and the corresponding information about the density, color value or glossiness. For example, if the information indicating the error in the detected loop amount shows that the loop amount is less than expected, it is only necessary to cause the ROM 601 and the like to store the table, in which the information indicating the error is associated with the information about how much to slow down the speed of the fixing part 34, for the control part 600 to reference. Alternatively, it may also be adapted to perform the loop amount control by causing the control part 600 to multiply a predetermined coefficient to the information about the error in the loop amount to obtain how much to slow down the rotational speed of the fixing part 34. These configurations can also improve the accuracy of the loop amount detection by detecting the loop amount at least with dependency on the density, color value or glossiness mitigated and can perform the accurate loop control.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-014101, filed Jan. 26, 2010, which is hereby incorporated by reference herein in its entirety.

What is claimed is:

1. An image forming apparatus for primarily transferring a toner image to an intermediate transfer member by a primary transfer unit, secondarily transferring the toner image primarily transferred to the intermediate transfer member to a transfer material by a secondary transfer unit, and fixing the image secondarily transferred to the transfer material with a fixing unit comprising:

a deflection amount detector disposed between the secondary transfer unit and the fixing unit, that detects information indicating a deflection amount of the transfer material by detecting a reflection of light from the transfer material;

a density detector that detects a density of the toner image that is primarily transferred to the intermediate transfer member with the primary transfer unit; and a controller that controls the deflection amount of the transfer material, based on correction information in which information indicating the deflection amount detected by the deflection amount detector is corrected based on the density of the toner image detected by the density detector.

2. An image forming apparatus according to claim 1, wherein the deflection amount detector detects information indicating the deflection amount at a position corresponding to the position on the toner image detected by the density detector in a main scanning direction perpendicular to a conveyance direction of the transfer material.

3. An image forming apparatus according to claim 1, wherein the controller controls the deflection amount detected by the deflection amount detector at a position corresponding to a predetermined position in the conveyance direction of the transfer material, based on the density of the toner image detected at the predetermined position in the conveyance direction by the density detector.

4. An image forming apparatus according to claim 1, wherein the deflection amount detector is disposed to face a surface of the transfer material to which the toner image is secondarily transferred with the secondary transfer unit.

5. An image forming apparatus according to claim 1, wherein the deflection amount detector is disposed to face a surface of the transfer material to which the toner image is not secondarily transferred with the secondary transfer unit, and the image forming apparatus further comprises a double-sided conveyance unit for reversing the transfer material that has an image formed on one side and feeding the transfer material to the secondary transfer unit in order to form an image on the back surface of the transfer material that has the image formed on the one side; and a storage unit that stores density information detected by the density detector on the intermediate transfer member for the image formed on the one side before the secondary transfer, and wherein the controller controls the deflection amount of the transfer material based on the stored density information and information indicating the deflection amount detected by the deflection amount detector, while the secondary transfer unit is secondarily transferring the toner image to the back surface of the transfer material.

6. An image forming apparatus according to claim 1, wherein the controller controls the deflection amount by controlling a conveyance speed of the transfer material that is conveyed while being nipped by a nip part of the fixing unit and the nip part of the secondary transfer unit respectively, by changing a rotation speed of the fixing unit.

7. An image forming apparatus according to claim 1, wherein the controller calculates:

a distance from the deflection amount detector to the transfer material based on the deflection amount detected by the deflection amount detector, and a correction distance for correcting the distance from the deflection amount detector to the transfer material based on the density of the toner image detected by the density detector, wherein the correction information is obtained by correcting the distance from the deflection amount detector to the transfer material based on the correction distance.

8. An image forming apparatus for primarily transferring a toner image to an intermediate transfer member by a primary transfer unit, secondarily transferring the toner image primarily transferred to the intermediate transfer member to a transfer material by a secondary transfer unit, and fixing the image secondarily transferred to the transfer material by a fixing unit comprising:

a deflection amount detector disposed between the secondary transfer unit and the fixing unit, that detects information indicating a deflection amount of the transfer material by detecting a reflection of light from the transfer material;

a detection unit that detects glossiness of the transfer material or a color value of the secondarily transferred image; and a controller that controls the deflection amount of the transfer material based on correction information in which information indicating the deflection amount detected by the deflection amount detector is corrected based on the glossiness of the transfer material or a color value of the secondarily transferred image.

9. An image forming apparatus according to claim 8, wherein the deflection amount detector detects information indicating the deflection amount at a position corresponding to the position on a transfer material detected by the detection unit in a main scanning direction perpendicular to a conveyance direction of the transfer material.

10. An image forming apparatus according to claim 8, wherein the controller controls the deflection amount detected by the deflection amount detector at a position corresponding to a predetermined position in the conveyance direction of the transfer material, based on the detection result detected at the predetermined position in the conveyance direction of the transfer material by the detection unit.

11. An image forming apparatus according to claim 8, wherein the detection unit is disposed on an upstream side of the deflection amount detector in the conveyance direction of the transfer material.

12. An image forming apparatus according to claim 8, wherein the deflection amount detector is disposed to detect the same surface as that of the transfer material detected by the detection unit.

13. An image forming apparatus according to claim 8, wherein the controller calculates:

a distance from the deflection amount detector to the transfer material based on the deflection amount detected by the deflection amount detector, and a correction distance for correcting the distance from the deflection amount detector to the transfer material based on the density of the toner image detected by the density detector, wherein the correction information is obtained by correcting the distance from the deflection amount detector to the transfer material based on the correction distance.

* * * * *